US009862119B2

(12) United States Patent
Gauthier et al.

(10) Patent No.: US 9,862,119 B2
(45) Date of Patent: Jan. 9, 2018

(54) WET CAST BRICK MOLDING EQUIPMENT, METHOD OF USING THE SAME AND BRICK MADE THEREWITH

(71) Applicant: Novabrik International Inc., Montreal, Quebec (CA)

(72) Inventors: Simon Gauthier, Rosemere (CA); Gonzalo Endara, Montreal (CA); Richard Marchand, Beauharnois (CA)

(73) Assignee: NOVABRIK INTERNATIONAL INC., Montreal (CA)

( * ) Notice: Subject to any disclaimer, the term of this patent is extended or adjusted under 35 U.S.C. 154(b) by 0 days.

(21) Appl. No.: 14/939,794

(22) Filed: Nov. 12, 2015

(65) Prior Publication Data

US 2016/0136841 A1 May 19, 2016

Related U.S. Application Data

(60) Provisional application No. 62/079,198, filed on Nov. 13, 2014.

(51) Int. Cl.

| | |
|---|---|
| ***B28B 7/00*** | (2006.01) |
| ***B28B 7/10*** | (2006.01) |
| ***B28B 7/06*** | (2006.01) |
| ***B28B 7/34*** | (2006.01) |
| *E04F 13/08* | (2006.01) |
| *E04F 13/14* | (2006.01) |

(52) U.S. Cl.

CPC ..... *B28B 7/0079* (2013.01); *B28B 7/0014* (2013.01); *B28B 7/0073* (2013.01); *B28B 7/06* (2013.01); *B28B 7/10* (2013.01); *B28B 7/348* (2013.01); *E04F 13/0864* (2013.01); *E04F 13/0873* (2013.01); *E04F 13/0894* (2013.01); *E04F 13/14* (2013.01)

(58) Field of Classification Search

CPC ..... B28B 7/0079; B28B 7/348; B28B 7/0014; B28B 7/06; B28B 7/0073; B28B 7/10; B28B 1/14; E04F 13/0864; E04F 13/0873; E04F 13/14; E04F 13/0894

USPC ..... 249/121, 127, 128, 139, 142, 144, 170

See application file for complete search history.

(56) References Cited

U.S. PATENT DOCUMENTS

| | | | | |
|---|---|---|---|---|
| 3,348,802 A * | 10/1967 | Corbett | B28B 7/0044 | 249/163 |
| 3,809,357 A * | 5/1974 | Gallap | B29C 44/1233 | 249/161 |
| 5,395,232 A * | 3/1995 | Hori | B29C 45/0441 | 425/409 |
| 6,773,641 B1 * | 8/2004 | Toncelli | B28B 7/348 | 264/102 |
| 7,575,700 B2 * | 8/2009 | Ishler | B28B 3/028 | 264/297.9 |

(Continued)

*Primary Examiner* — Matthew Daniels
*Assistant Examiner* — Leith S Shafi
(74) *Attorney, Agent, or Firm* — Pierre Cantin; Brouillette Legal Inc.

(57) ABSTRACT

Molding equipment comprising a mold having at least one cavity is disclosed. Each cavity allows the formation of a brick. A brick molding element is installed on top of each cavity to allow the formation of a mortise interlock element. The brick molding element is typically secured in place by mean of a securing mechanism. The molding equipment may be used for molding a variety of inter-engaging stackable brick element.

16 Claims, 39 Drawing Sheets

(56) References Cited

U.S. PATENT DOCUMENTS

| | | | | |
|---|---|---|---|---|
| 2003/0182011 | A1* | 9/2003 | Scherer | B28B 3/08 700/117 |
| 2005/0211871 | A1* | 9/2005 | Ness | B28B 7/0014 249/140 |

* cited by examiner

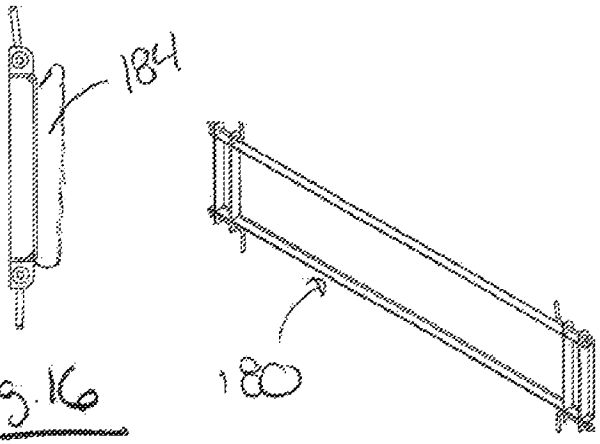
Fig. 16
Fig. 17
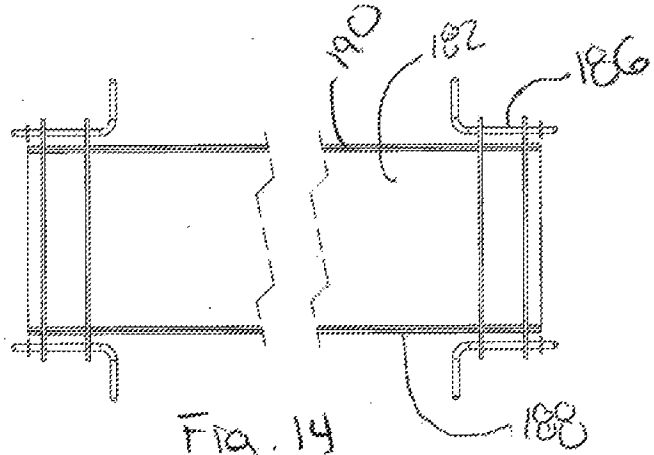
Fig. 14
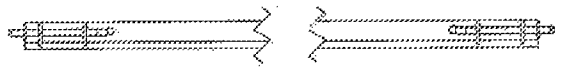
Fig. 15

WET CAST BRICK MOLDING EQUIPMENT, METHOD OF USING THE SAME AND BRICK MADE THEREWITH

CROSS-REFERENCE TO RELATED APPLICATIONS

The present patent application claims the benefits of priority of U.S. Patent Application No. 62/079,198, entitled "Wet Cast Brick Molding Equipment, Method of Using the Same and Brick made therewith", and filed at the United Stated Patent and Trademark Office on Nov. 13, 2014, the content of which is incorporated herein by reference.

FIELD OF THE INVENTION

The present invention relates to the field of stackable inter-engaging bricks, blocks, stones and the like for building mortarless walls. This invention relates more precisely to the process of manufacturing individual smooth or embossed face inter-engaging bricks, blocks, stones and the like. As used herein, the word "bricks" also refers to blocks, stones and the like.

BACKGROUND OF THE INVENTION

Stackable inter-engaging bricks are used to build mortarless walls and this is known in the art. Wall building blocks which may be stacked and interlocked without being held together by a binding agent such as mortar are known. One such block has a top face which comprise a tongue element and a bottom face which comprise a mortise element. Both elements are configured in such a way that when two blocks are stacked, the bottom face of a block engages with the top face of a like block disposed below while the top face of the block engages with the bottom face of an above-disposed block. An example of such a block is shown in U.S. Pat. No. 6,108,995 (Bouchard et al.).

In the process of manufacturing stackable inter-engaging bricks, multiple attached splittable bricks made of brick material such as concrete are first cast in a metal mold. The molded attached brick units are then extracted from the said mold and conveyed through the manufacturing plant on steel or wood plates. The molded attached brick units are then cured in kilns in order to cure the said brick material. Once cured, each of the attached bricks are detached in the middle in two individual split face bricks by the mean of a known splitting equipment. In this embodiment, every molded attached brick unit can produce two split face bricks.

The reason for manufacturing two split face bricks from a single attached splittable brick unit is found in the fact that, prior the completion of the curing procedure, an uncured single brick would be too fragile to be conveyed in the manufacturing plant without being unacceptably damaged or deformed in the process. Conveying uncured individual prior art bricks would result in an increase of defective or rejected bricks.

Also, the process of cutting attached brick units into individual bricks causes the bricks to have split faces, which may not be always desired.

Other methods for making mortarless bricks such as wet cast fail to result in properly formed inter-engaging features as existing wet cast mold require the mold to be filed with an open top portion.

There is thus a need to find a mean by which stackable bricks could be molded, conveyed and cured individually without being damaged or deformed unacceptably and in such a way that the resulting brick faces could be smooth, embossed or preferably have alternating design to represent a design as close as possible to a design obtain from the use of conventional bricks, stones and mortar materials.

SUMMARY OF THE INVENTION

The shortcomings of the prior art are generally mitigated by providing a molding equipment having unmolding features integrated thereto and by providing a flexible mold cover having a protruding portion creating the inter-engaging stackable lip portion of the brick.

According to one aspect of the present invention, a method to manufacture various form of individual smooth, embossed or predetermined textured face bricks is provided. Each of the bricks has a tongue interlock element and a mortise interlock element configured in such a way that the bricks are in a mutual engagement when bricks, blocks or stones or the like are stacked one of top of the other.

Molding equipment in accordance with the present invention comprises a mold having at least one and preferably a plurality of cavities. Each cavity allows the formation of a brick. A brick molding element is installed on top of each cavity to allow the formation of a mortise interlock element. The brick molding element is typically secured in place by mean of a fastening device such as screws or bolts.

The method generally comprises: a) selecting the individual molds in which individual texture of a face of the bricks are to be molded, b) placing the molding portion in the structural base portion c) adding some amount of wet cast concrete in the molded cavities, d) placing the cover portion on top of the molding portion by carefully inserting the cover insert in their respective position in the complementary portion of the molding cavities, e) locking the securing mechanism 186 of the cover portion 180 to respectively secure the cover portion on the molding portion, f) adding wet cast concrete to fill the molding cavities until the desired quantity of concrete has been added, g) if required, removing any excess concrete placed in the cavities and producing a plane surface, h) storing the molding equipment away for drying and/or curing.

According to one aspect of the present invention, the wet cast brick molding equipment typically permits for the molding of a plurality of brick elements in a simultaneous manner. Consequently, depending on the embodiment of the invention, the brick molding may have 1, 2, 3, or as many as 10 brick elements simultaneously molded. The quantity of brick molded therein will vary according to the number of molding cavities.

According to one aspect of the present invention, the wet cast brick mold is configured to be stackable as to allow easy storage of the molded brick element during the drying period.

According to one aspect of the present invention, the molding equipment may, depending on the embodiment, be used for molding various types of inter-engaging stackable bricks such as main brick element, finishing top plate and corners.

According to one aspect of the present invention, it is disclosed a wet cast molding equipment for molding individual stackable inter-engaging bricks without being damaged or deformed during molding, the molding equipment comprising:

- a main body comprising a molding module having a molding cavity adapted to cast an appropriate material to produce the brick, the molding module defining a first brick longitudinal side and a second brick longitudinal side; and a cover releasably secured to the main body, the cover comprising a cover insert having a lip forming element for creating an inter-engaging lip portion on the brick, the cover at least partially covering the molding cavity.

According to one aspect of the present invention, the molding equipment may have a main body further comprising a structural base portion comprising first and second side elevation elements.

According to one aspect of the present invention, the first and second side elevation elements of the molding equipment may have a molding opening and a releasing opening, wherein the molding opening supports a first elongated member inserted in the main body, about the first longitudinal side.

According to one aspect of the present invention, the molding equipment may have a first elongated member kept in the molding opening of the first and second side elevation elements during molding of the brick and in placed in the releasing opening for supporting the first elongated member during the unmolding of the brick.

According to one aspect of the present invention, the molding equipment may comprise side elevation members having securing openings for securing the cover to the main body.

According to one aspect of the present invention, the side elevation members of the molding equipment may comprise suitable securing mechanisms for retaining the cover on top of the molding cavity during molding.

According to one aspect of the present invention, the main body of the molding equipment may have a first elongated member and a second elongated member longitudinally inserted thereto.

According to one aspect of the present invention, the molding equipment may further have a cover plate comprising longitudinally elevated sides for increasing the cover longitudinal and torsional strength.

According to one aspect of the present invention, the cover plate may be secured to the cover insert using glue, and/or any suitable fasteners.

According to one aspect of the present invention, the cover insert may be made from a suitably flexible material as used for the molding cavity to promote easy unmolding of the brick.

According to one aspect of the present invention, the main body of the molding equipment may comprise three distinct molding cavities and three corresponding cover inserts.

According to one aspect of the present invention, the side of the cover insert opposite to a side forming the lip forming element may be at an angle with a vertical plane formed by a lower face of the brick to promote easy removal of the cover insert and the brick upon completion of molding processes.

According to one aspect of the present invention, the molding equipment may further comprise an unmolding aid formed from an arc plate integrated to the structural base portion for easy removal of the brick, from the molding cavity.

According to one aspect of the present invention, the molding equipment may comprise an arc plate member mounted on the structural base portion and engaging with both side elevation members through apertures located thereto.

According to one aspect of the present invention, the structural base portion of the molding equipment may have weight reducing openings located under the arc plate to reduce the weight of the structure as long.

According to one aspect of the present invention, it is disclosed a brick made using the wet cast molding equipment of the present invention.

According to one aspect of the present invention, it is disclosed a method of making wetcast brick using a molding equipment having a molding module and a cover, the method generally comprising the steps of:

adding some amount of wet cast concrete in a molding cavity of the molding module, placing the cover on top of the molding cavity by carefully inserting a cover insert in its respective position in a complementary portion of the molding cavity, and releasably securing the cover on the molding module to at least partially cover the molding cavity.

According to one aspect of the present invention, the method of making wetcast brick may further comprising the steps of:

placing the molding module in a structural base portion; and inserting a first elongated member in a molding opening of both side elevation members.

According to one aspect of the present invention, the method of making wetcast brick may further comprising the steps of:

removing any excess concrete placed in the cavities and producing a plane surface; and storing the molding equipment away for drying and/or curing.

According to one aspect of the present invention, the method of making wetcast brick may further comprising the steps of:

removing a first elongated member from the molding opening and removing the molding portion from the structural base portion;

inserting the first elongated member in the unmolding opening of both side elevation members; and applying a downward pressure to a second elongated member located on the opposite side of the molding module in relation to the first elongated member to force the extraction of the brick and cover insert from the molding cavities, and remove the brick from the molding module.

The invention is also directed to a wet cast molding equipment for molding individual stackable inter-engaging bricks without being damaged or deformed during molding, the molding equipment comprising:

a structural base portion comprising a base plate, right and left side elevation members extending vertically from the base plate, and a stopper plate extending vertically from the base plate between right and left side elevation members;

a molding module adapted to be received into the structural base portion and having at least one molding cavity adapted to cast a material adapted to be cast to produce a brick, the molding module defining a first brick longitudinal side and a second brick longitudinal side; and a cover releasably secured to the structural base, the cover comprising a cover insert having a lip forming element for creating an inter-engaging lip portion on the brick, the cover at least partially covering the at least one molding cavity;

wherein each of the right and left side elevation members comprises a molding opening forming a notch adjacent to the stopper plate, the molding openings being adapted for receiving and supporting a first elongated member extending from the molding module, maintaining as such the molding module in place in the structural base during molding.

According to a preferred embodiment, each of the first and second side elevation elements comprises a releasing opening forming a notch adjacent to the molding opening to receive and support the first elongated member of the molding module during the unmolding of the brick.

According to a preferred embodiment, the side elevation members comprise securing mechanisms for retaining the cover on top of the molding cavity during molding. The securing mechanisms comprise securing openings through the side elevation members configured for receiving a bar member extending horizontally from the cover.

The invention is also directed to a method of making wetcast brick using the wet cast molding equipment defined above, the method comprises the steps of:

a) placing the molding module in the structural base portion by inserting the first elongated member in the molding openings each forming a notch adjacent to the stopper plate;
b) adding some amount of the material adapted to be cast to produce the brick in the molding cavity of the molding module,
c) placing the cover on top of the molding cavity by inserting the cover insert in its respective position in a complementary portion of the molding cavity, and
d) releasably securing the cover on the molding module to at least partially cover the molding cavity.

According to a preferred embodiment, the method further comprises the steps of:

e) removing any excess concrete placed in the cavities for producing a plane surface; and
f) storing the molding equipment away for drying and/or curing.

According to a preferred embodiment, the method further comprises the steps of:

g) removing the first elongated member from the molding openings and removing the molding portion from the structural base portion;
h) inserting the first elongated member in releasing openings, each forming a notch on both side elevation members adjacent to the molding openings;
i) applying a downward pressure to a second elongated member located on the opposite side of the molding module in relation to the first elongated member to force the extraction of the brick and cover insert from the molding cavities, and remove the brick from the molding module.

Other and further aspects and advantages of the present invention will be obvious upon an understanding of the illustrative embodiments about to be described or will be indicated in the appended claims, and various advantages not referred to herein will occur to one skilled in the art upon employment of the invention in practice.

BRIEF DESCRIPTION OF THE DRAWINGS

The above and other aspects, features and advantages of the invention will become more readily apparent from the following description, reference being made to the accompanying drawings in which:

FIG. 4 is a right elevation view of the wet cast brick molding equipment of FIG. 1.

FIG. 14 is a top plan view of the cover portion of the wet cast brick molding equipment of FIG. 1

FIG. 15 is a front view of the cover portion of FIG. 14.

FIG. 16 is a right elevation view of the cover portion of FIG. 14.

FIG. 17 is a perspective view of the cover portion of FIG. 14.

FIG. 57 is a perspective view the cover insert of the wet cast brick molding equipment of FIG. 56.

DETAILED DESCRIPTION OF THE PREFERRED EMBODIMENT

Figure 1:
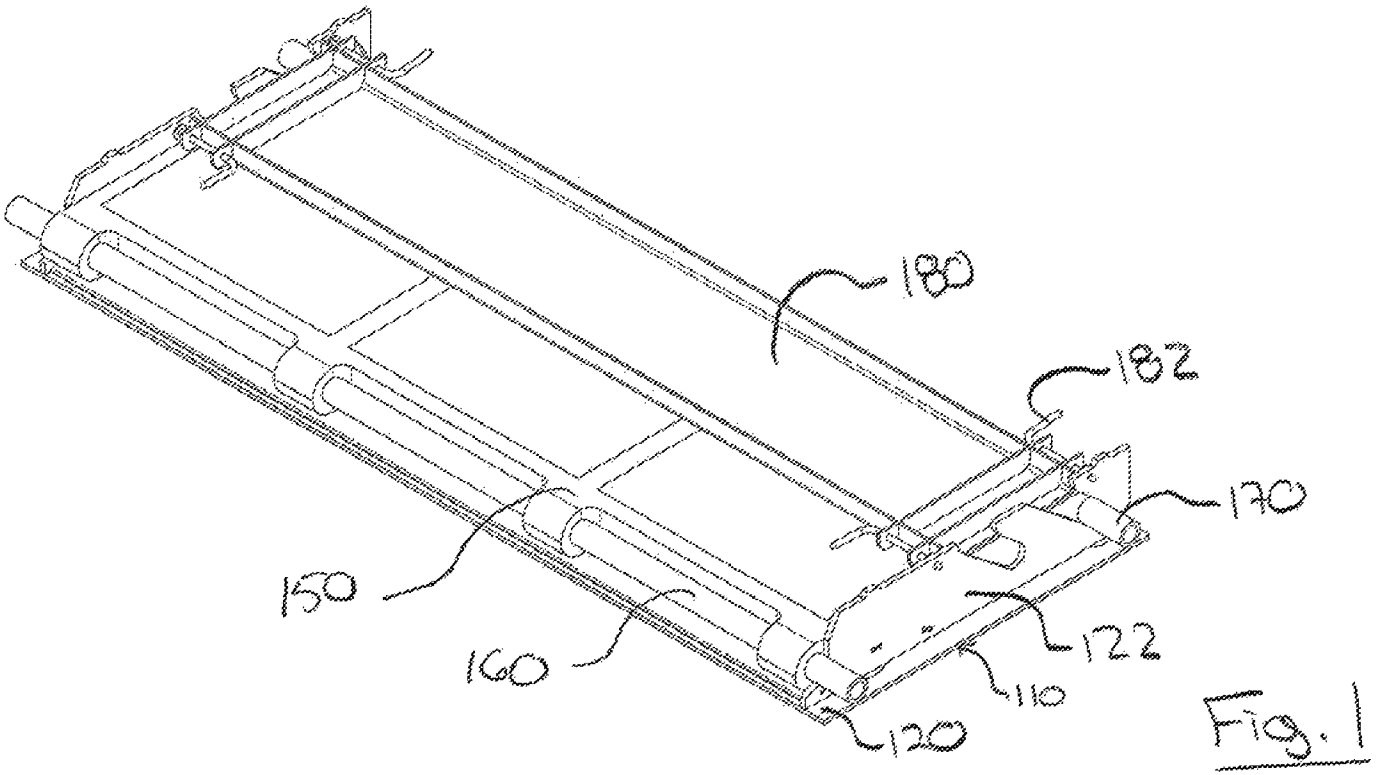
FIG. 1 is a perspective view of the wet cast brick molding equipment for a brick element.
Figure 1:
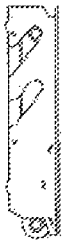
Figure 2:
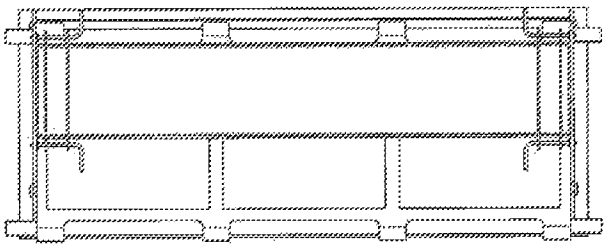
FIG. 2 is a top plan view of the wet cast brick molding equipment of FIG. 1.
Figure 3:
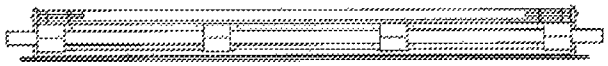
FIG. 3 is a rear elevation view of the wet cast brick molding equipment of FIG. 1.
Figure 7:
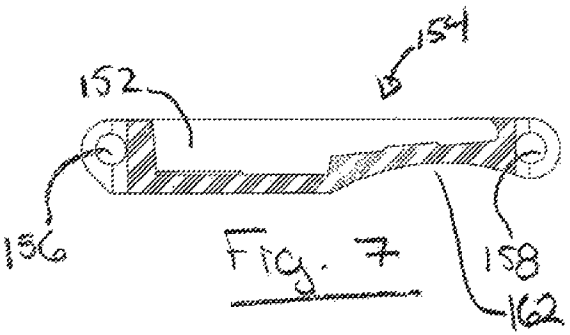
FIG. 7 is a cross-sectional view along A-A axis of the molding element of FIG. 6.
Figure 8:
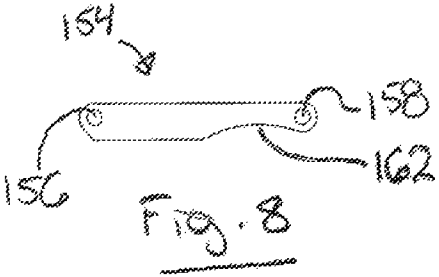
FIG. 8 is a right elevation view of the wet cast brick molding equipment of FIG. 1.
Figure 5:
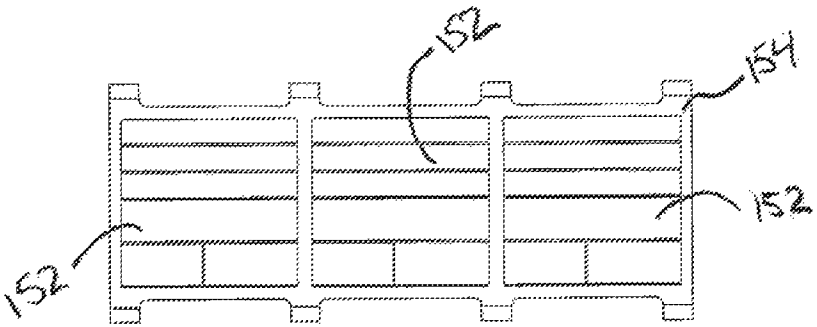
FIG. 5 is a top plan view of the molding element of the wet cast brick molding equipment of FIG. 1.
Figure 6:
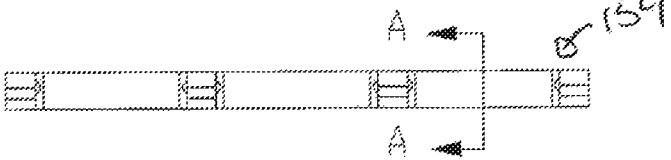
FIG. 6 is a front elevation view of the molding element of FIG. 5.
Figure 11:
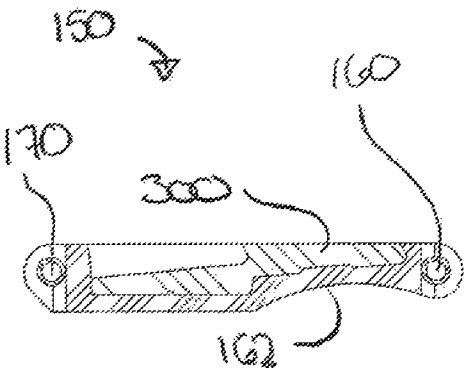
FIG. 11 is a cross-sectional view along A-A axis of the molding element of FIG. 10.
Figure 10:
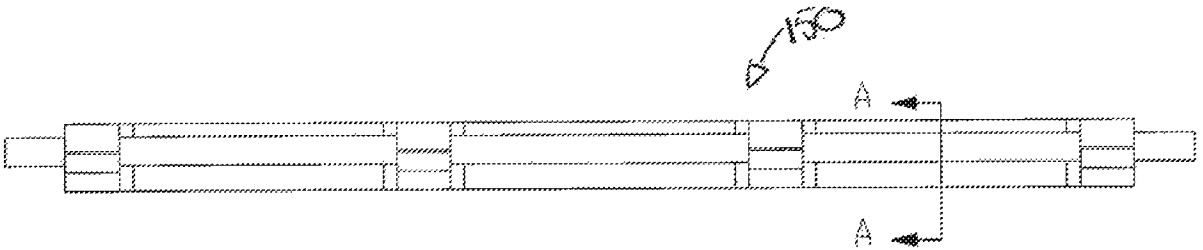
FIG. 10 is a front elevation view of the molding element of FIG. 10.
Figure 9:
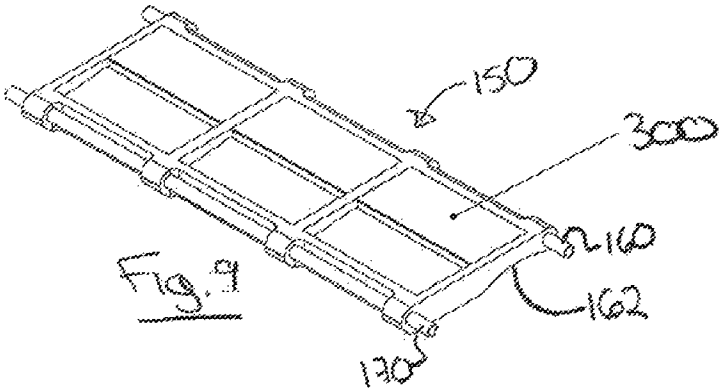
FIG. 9 is a perspective view of the molding portion of the wet cast brick molding equipment of FIG. 1 having brick element molded therein.

A novel wet cast brick molding equipment, method to manufacture the same and brick made therewith will be described hereinafter. Although the invention is described in terms of specific illustrative embodiments, it is to be understood that the embodiments described herein are by way of example only and that the scope of the invention is not intended to be limited thereby.

The expressions "lip", "lip portion" as used therein, for example in the expression "lip forming element" should be understood as a round shaped lip, but also cover a triangular lip element or any other suitable form to fulfill the present invention. As such, lip should be understood as any shape that allows the brick element to be retained on top of one another to form individual stackable inter-engaging bricks as disclosed herein.

Now referring to FIGS. 1-11, in the present embodiment, the wet cast brick molding equipment 100 generally comprises a structural base portion 110, a molding portion 150 and a cover portion 180. The structural base portion 110 typically holds the molding portion 150 during molding of the wet cast concrete while the cover portion 180 is typically used to retain an important protrusion portion, also referred as a lip forming element 184 for creating the inter-engaging lip portion 186 of the brick element 300 molded therein.

Figure 12:
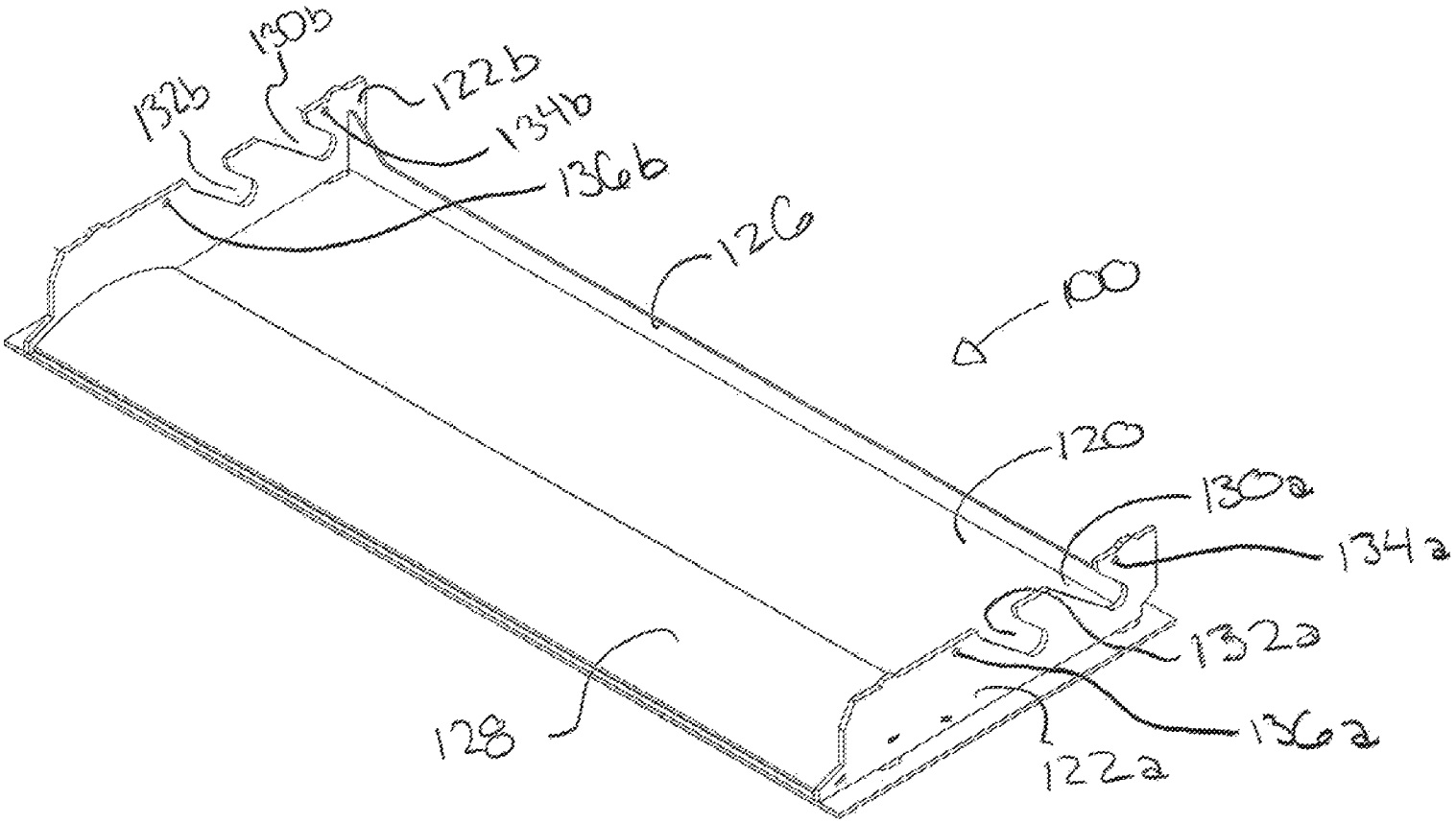
FIG. 12 is a perspective view of the structural base portion of the molding portion of the wet cast brick molding equipment of FIG. 1
Figure 13:
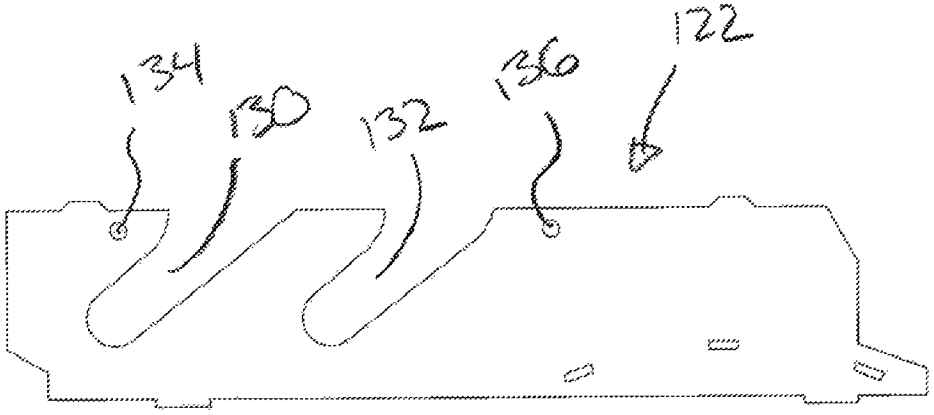
FIG. 13 is a lateral elevation view of the side elevation members of the wet cast brick molding equipment of FIG. 1
Figure 21:
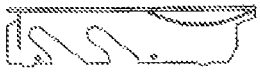
FIG. 21 is a cross-sectional view along A-A axis of the structural base portion of FIG. 18.
Figure 18:
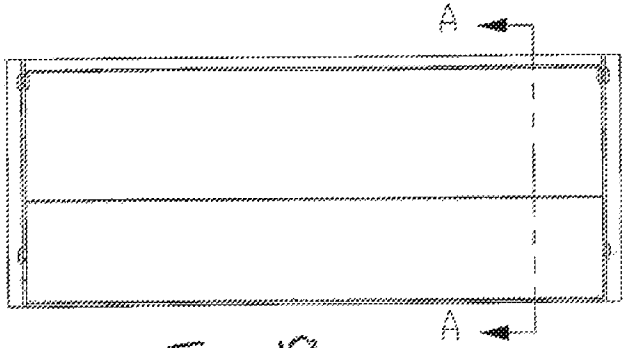
FIG. 18 is a top plan view of the structural base portion of the wet cast brick molding equipment of FIG. 1.
Figure 19:
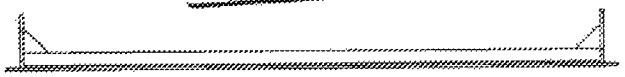
FIG. 19 is a rear elevation view of the structural base portion of FIG. 18.
Figure 20:
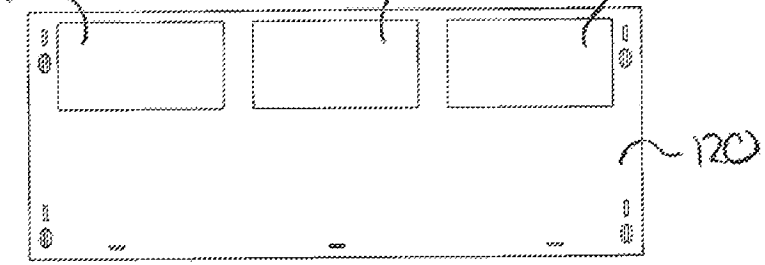
FIG. 20 is a bottom plan view of the structural base portion of FIG. 18.
Figure 22:
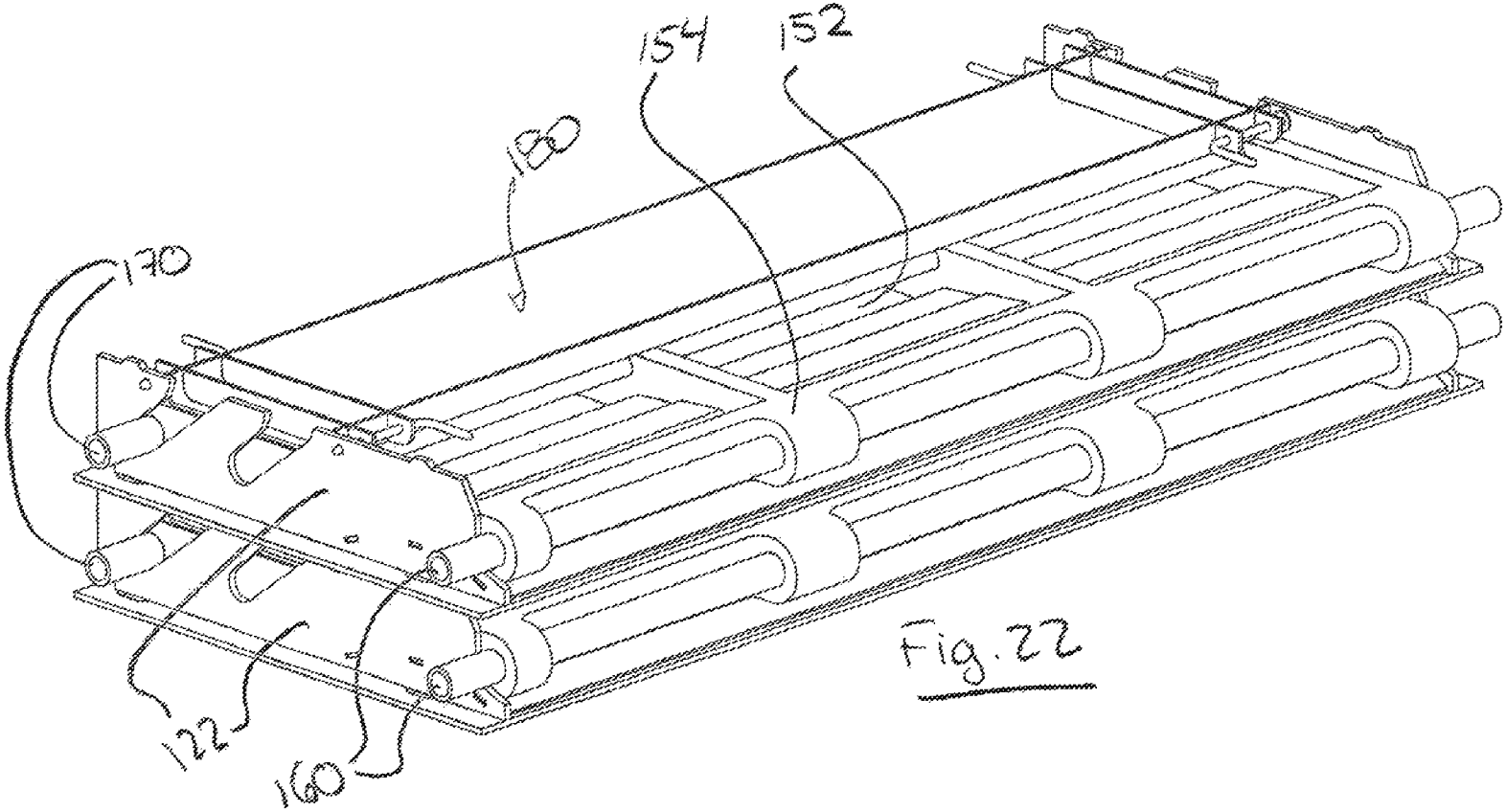
FIG. 22 is a perspective view of a plurality of the wet cast brick molding equipment of FIG. 1 stacked one onto the other.

Now referring to FIGS. 12-13, in the present embodiment, the structural base portion 110 generally comprises a base plate 120, right and left side elevation member 122*a*, 122*b* generally mounted thereto and a stopper plate 126 also mounted thereto, preferably engaging with both side elevation members 122*a*, 122*b*. Additionally, according to the present embodiment, the structural base portion 110 preferably comprises an arc plate member 128 mounted on the base plate 120 and engaging with both side elevation members 122*a*, 122*b* through apertures located thereto. According to another embodiment, the arc plate 128 could be secured using fasteners or any other suitable means provided the arc plate is solidly fixated to the base plate 120 and/or to both side elevation members 122*a*, 122*b*. The base plate 120, preferably has opening 138 located under the arc plate 128 to reduce the weight of the structure as long as sufficient strength is retained from the base plate 120 and overall structural base portion 110.

Now referring to FIGS. 1-13, in the present embodiment, the side elevation member 122 typically comprises a molding opening 130 and a releasing opening 132. The molding opening 130 is configured to support a first elongated member 170 inserted in the preferably malleable portion 154 of molding element 150. As such, the first elongated member 170 is kept in the molding opening 130 on both sides of the structural base portion 110 during molding of the brick element 300 whereas the releasing opening 132 is configured to support the first elongated member 170 during unmolding of the brick element 300. Furthermore, the side elevation members 122*a*, 122*b* generally have openings 134 (134*a*, 134*b*), 136 (136*a*, 136*b*) for securing the cover portion 180 thereto. Understandably, although openings are preferred, the side elevations 122 could comprise any suitable securing mechanisms for retaining the cover portion 180 on top molding portion 150 after pouring of a portion of the wet cast concrete the molding of the brick element 300.

Now referring to FIGS. 5-11, in the present embodiment, the molding portion 150 generally comprises a molding element having molding cavities for molding of the individual brick element. In addition, the molding element preferably has a first 170 and second 160 elongated member longitudinally inserted thereto via openings 156, 158. The at least one, preferably a plurality of molding cavities 152 for molding brick elements 300 may varies in design depending on the specific brick element 300 to be molded. The first 170 and second 160 elongated members partly integrated to the molding element 154 are preferably of cylindrical shapes as to promote easy insertion in the molding opening 130 and a releasing opening 132 of the elevated side members 122*a*, 122*b*.

Now referring to FIGS. 14-23, in the present embodiment, the cover portion 180 generally comprises a cover plate 182, a cover insert 184 also referred as a protruding portion and a securing mechanism 186 for securing the cover to the a structural base portion 110. The cover plate also preferably comprises longitudinally elevated sides for increasing the cover portion 180 longitudinal and torsional strength. Understandably, the longer the cover portion 180 is, according to the higher number of molding cavities, the more the need for increased longitudinal and/or lateral reinforcement elements such as longitudinally elevated sides. For instance, one could have a cover portion 180 with transverse longitudinal or lateral reinforcement along the top side of the cover portion 180.

Now referring to FIGS. 22-27 in the present embodiment, the cover plate 182 is generally secured to the cover insert 184 using glue, and/or any suitable fasteners. Another embodiment could as well have a reversibly secured cover insert to increase versatility of the molding equipment. As such, the user could use the same molding equipment for various typed of inter-engaging stackable mortarless bricks or blocks. The cover insert 184 is typically made from a suitably flexible material as used for the molding portion to promote easy unmolding of the brick element. Although less preferable, hardened material such as steel, hardened or low flexibility thermoset polymers, could also be used as cover insert 184.

Figure 23:
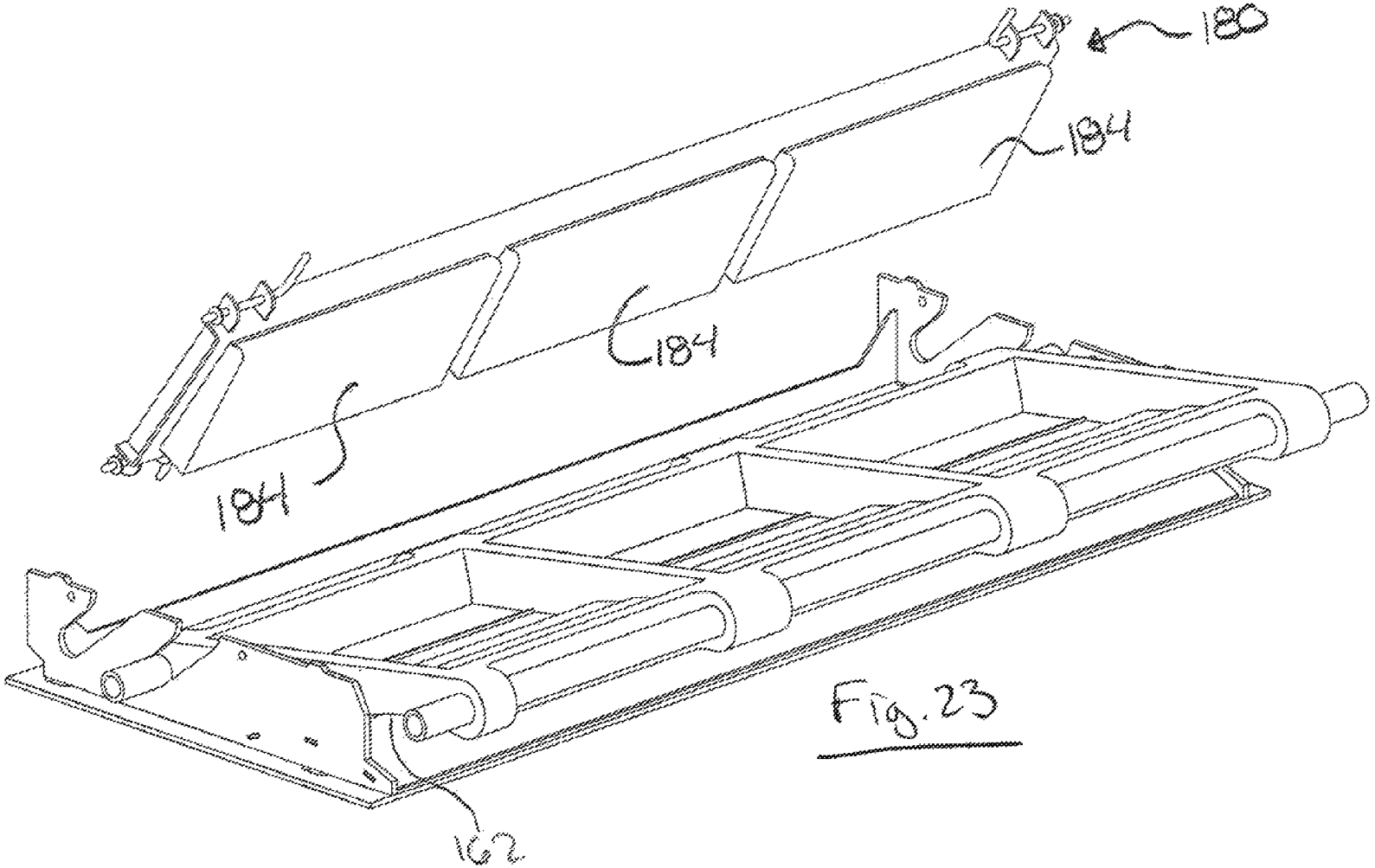
FIG. 23 is an exploded view of the wet cast brick molding equipment of FIG. 1 in and unmolding position.
Figure 24:
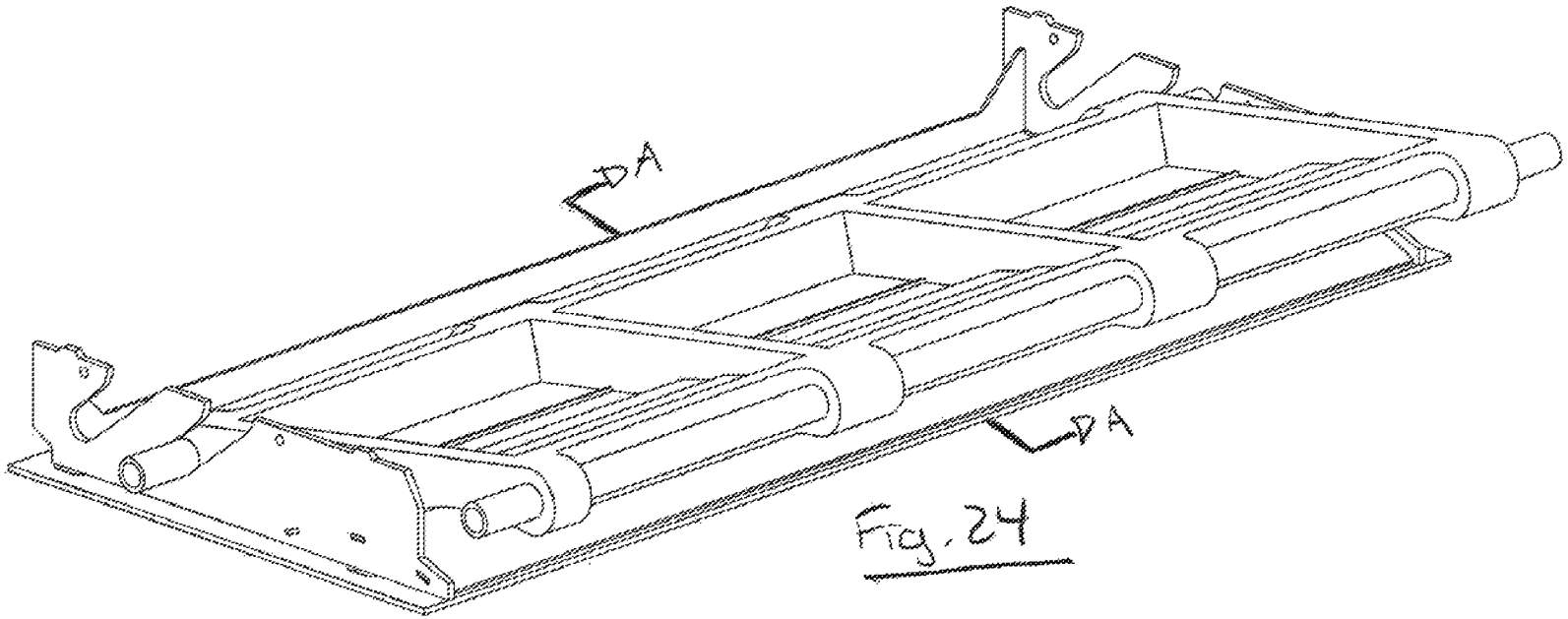
FIG. 24 is a perspective view of the structural base portion and molding portion of the wet cast brick molding equipment of FIG. 1 in and unmolding position.
Figure 25:
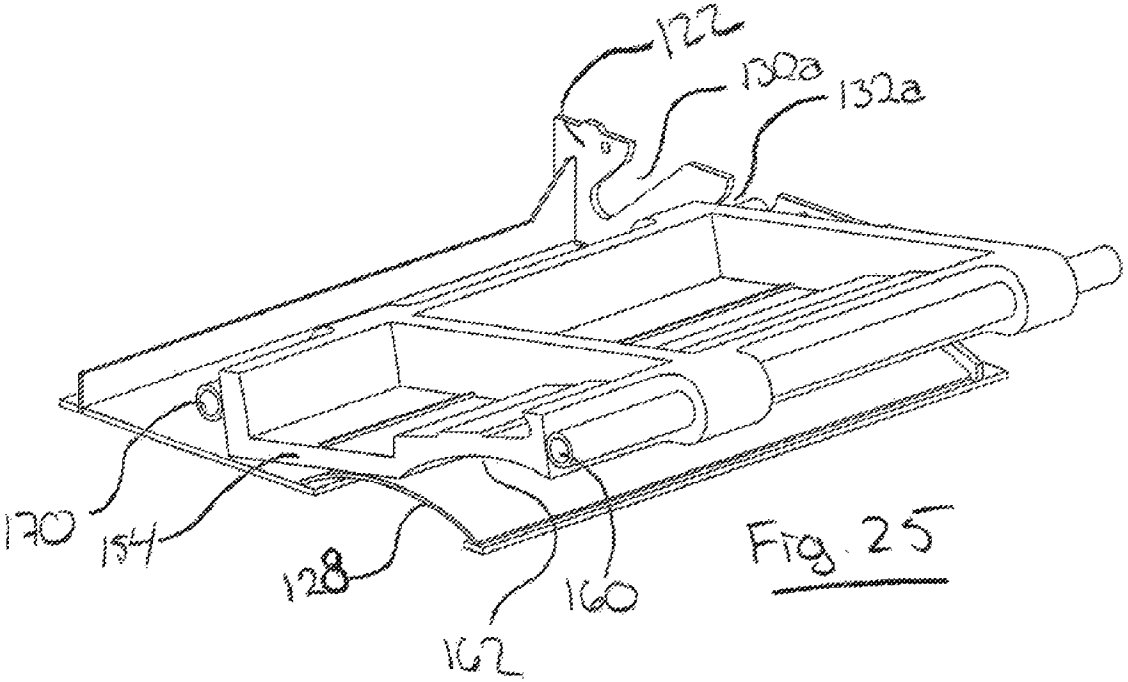
FIG. 25 is a cross-sectional view along A-A axis of the structural base portion of FIG. 24.
Figure 26:
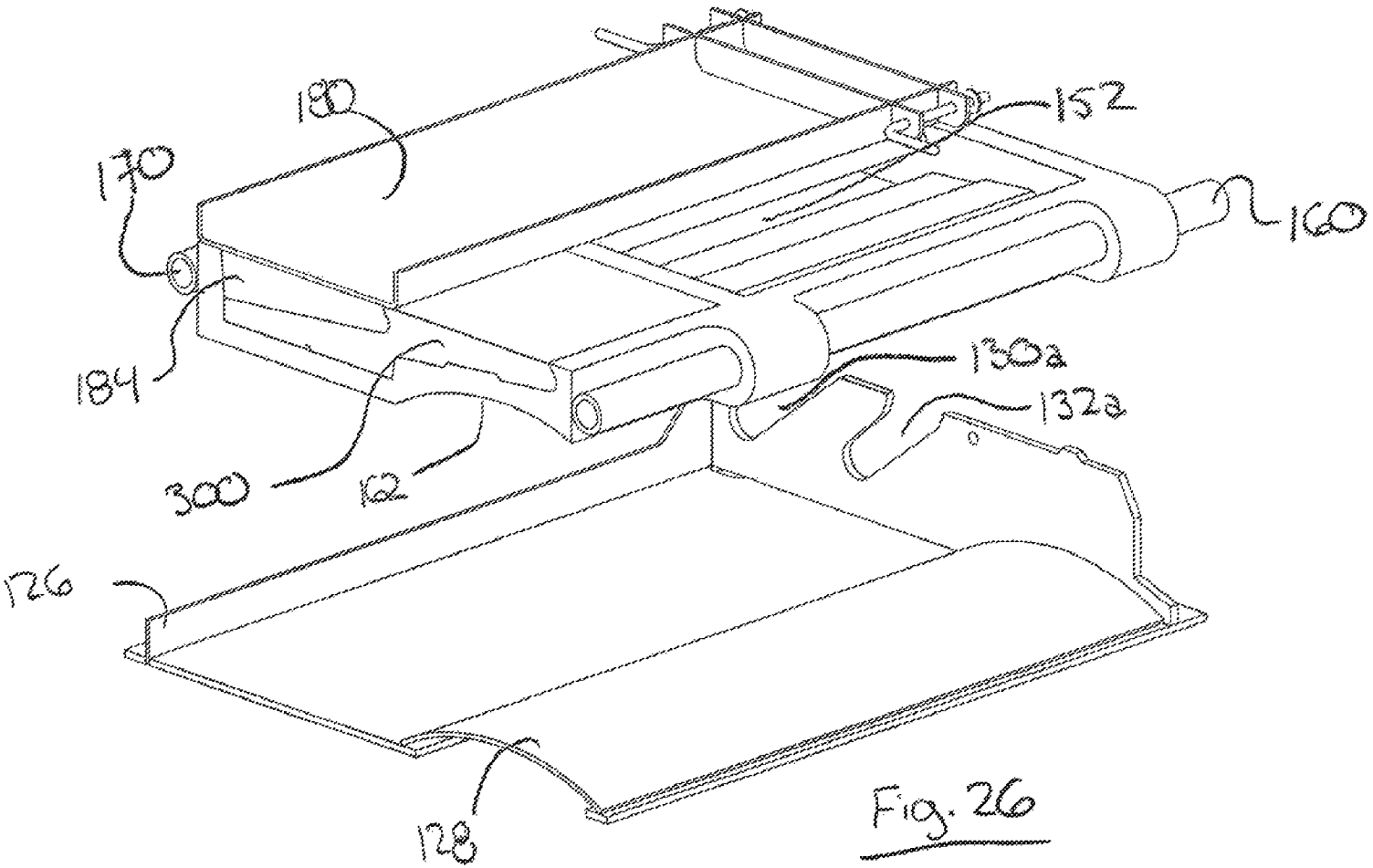
FIG. 26 is an exploded cross sectional view of the wet cast brick molding equipment of FIG. 24.

Now referring to FIGS. 23-24, in the present embodiment, the molding portion 150 comprises three distinct molding cavities 152 and three corresponding cover inserts 184. Understandably, another embodiment could have a different number of molding cavities 152 and cover insert 184 for insertion on top thereof. The higher quantity of molding cavities 152, the stronger will the other components have to be. For instance, for a wider i.e. more than three molding cavities 152, the elongated members 160, 170 and structural base portion 110 will require adequate reinforcements. The molding cavities will vary depending in the type of brick element 300 to be molded therein. Bricks element 300 such as regular brick (typical building block having a brick plate having an individual smooth, embossed or predetermined textured face decorative portion and a securing portion for securing to the wall of substantially vertical section with the aid of fasteners), plate (double size for completing a top layer and to provide adjustment for the last top layer), corner (angled edges to allow for compatible with complementary edges from other brick elements) and cap portion (a brick element comprising the brick face with an longitudinal prism shaped plate cover for finishing a top layer or for decoration a window opening) may all be moulded using various embodiment of the present molding equipment as long as a cover portion is secured to allow the creation of the lip element in the brick element molded therein.

Figure 27:
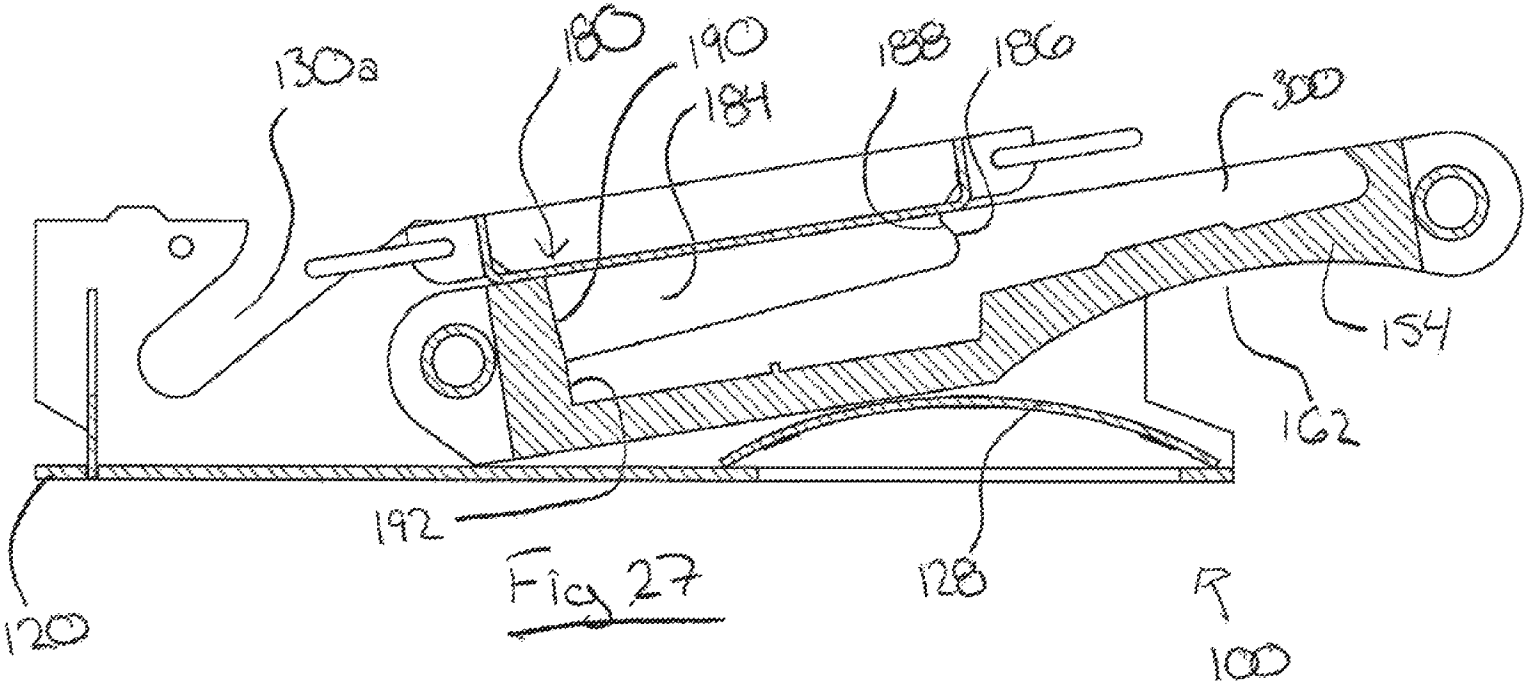
FIG. 27 is a cross-sectional view along A-A axis of the wet cast brick molding equipment of FIG. 24 having a brick element molded therein.
Figure 28:
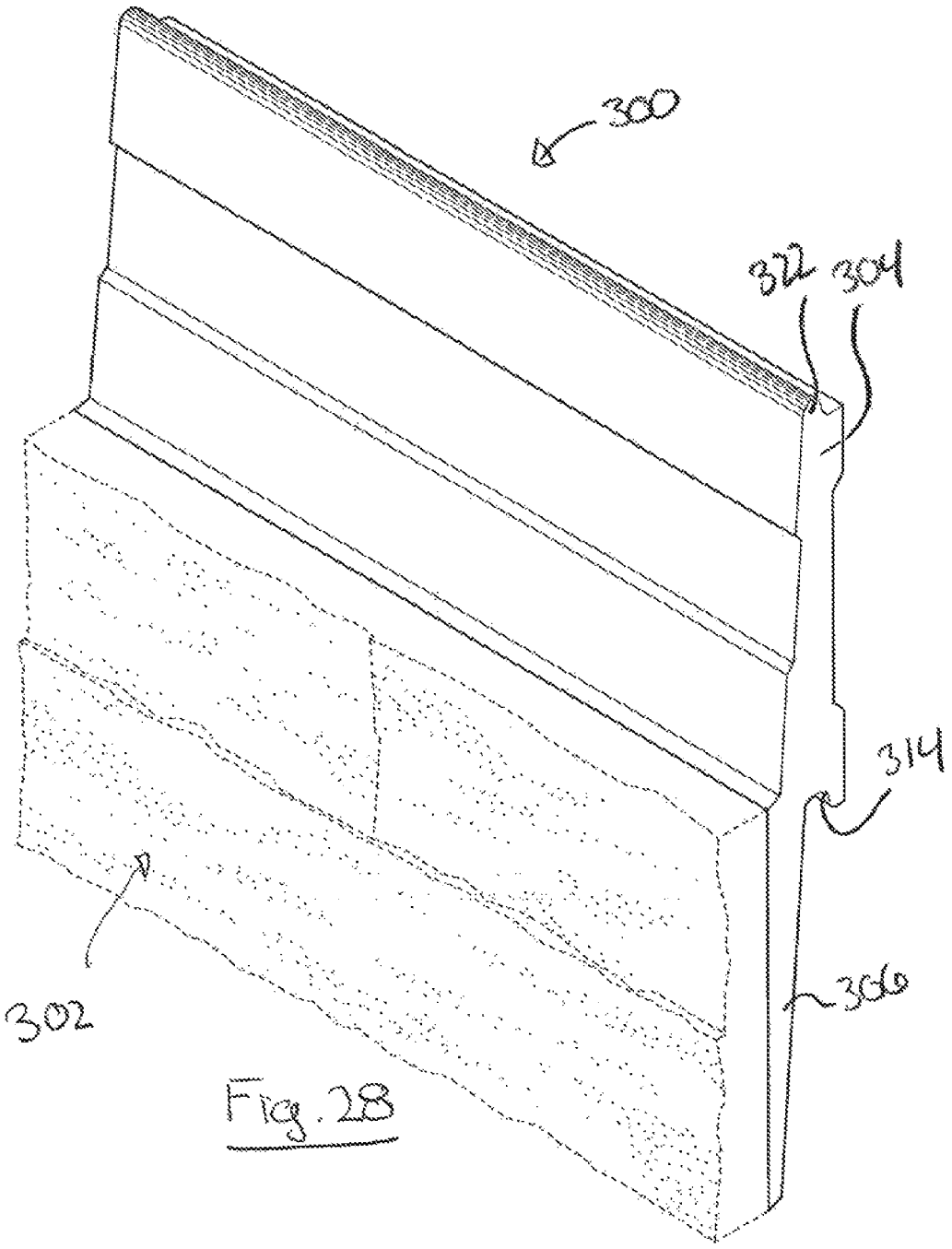
FIGS. 28-34 are perspective, left, right, top, bottom, front and rear views of a brick molded using a molding equipment of the present invention.
Figure 29:
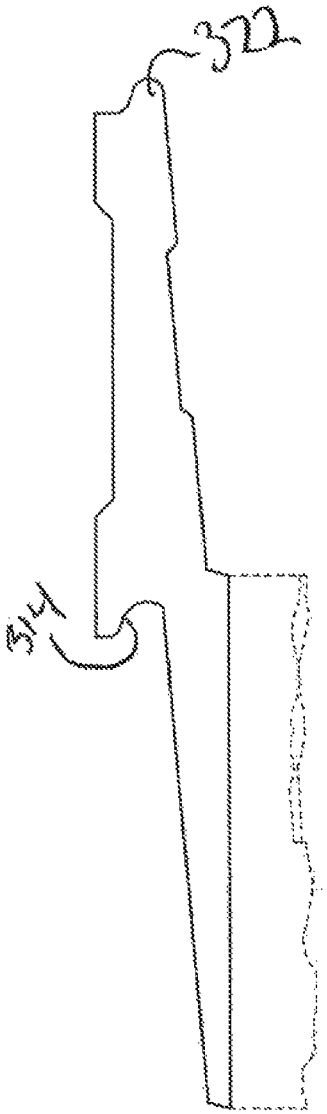
Figure 30:
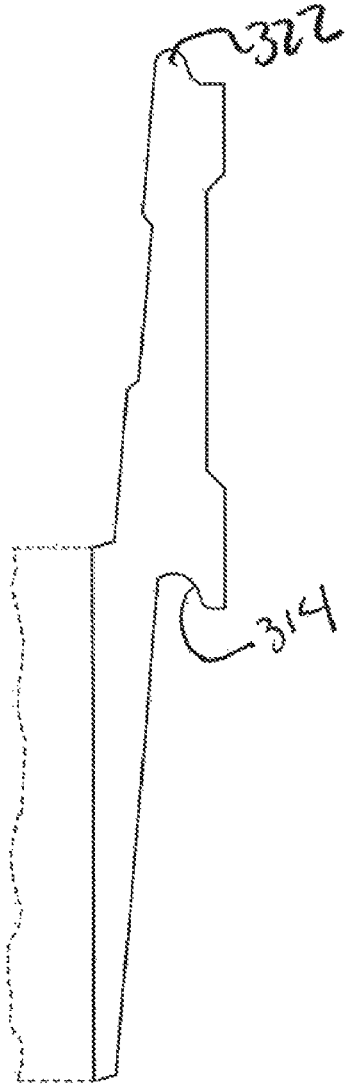
Figure 31:
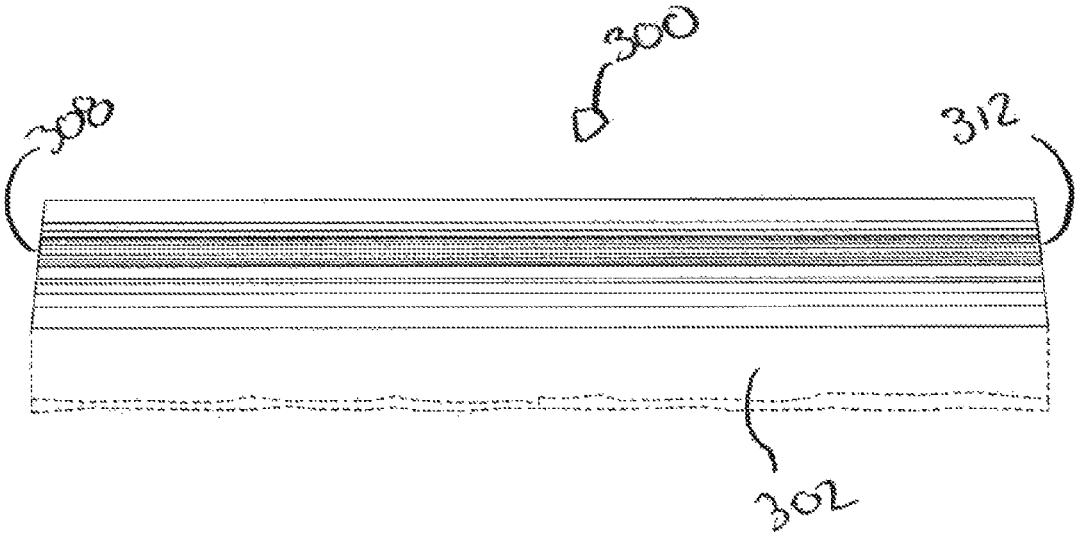
Figure 32:
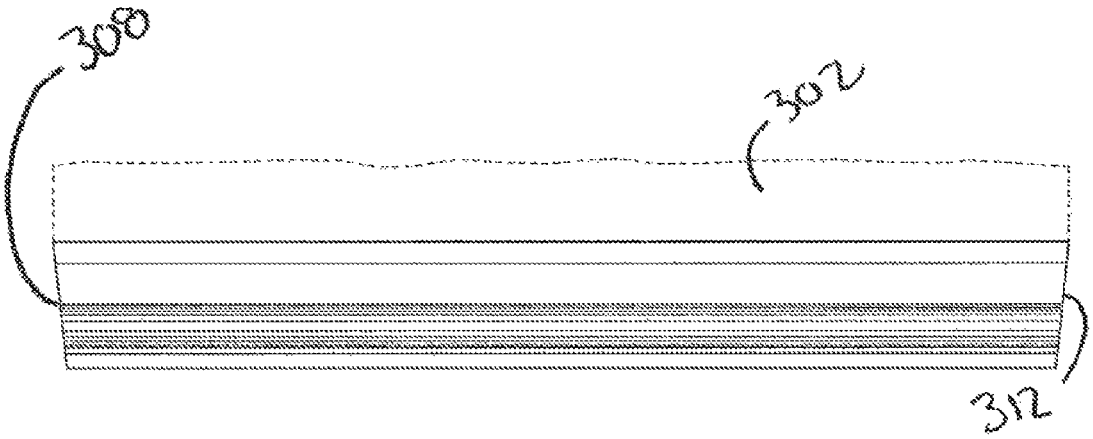
Figure 33:
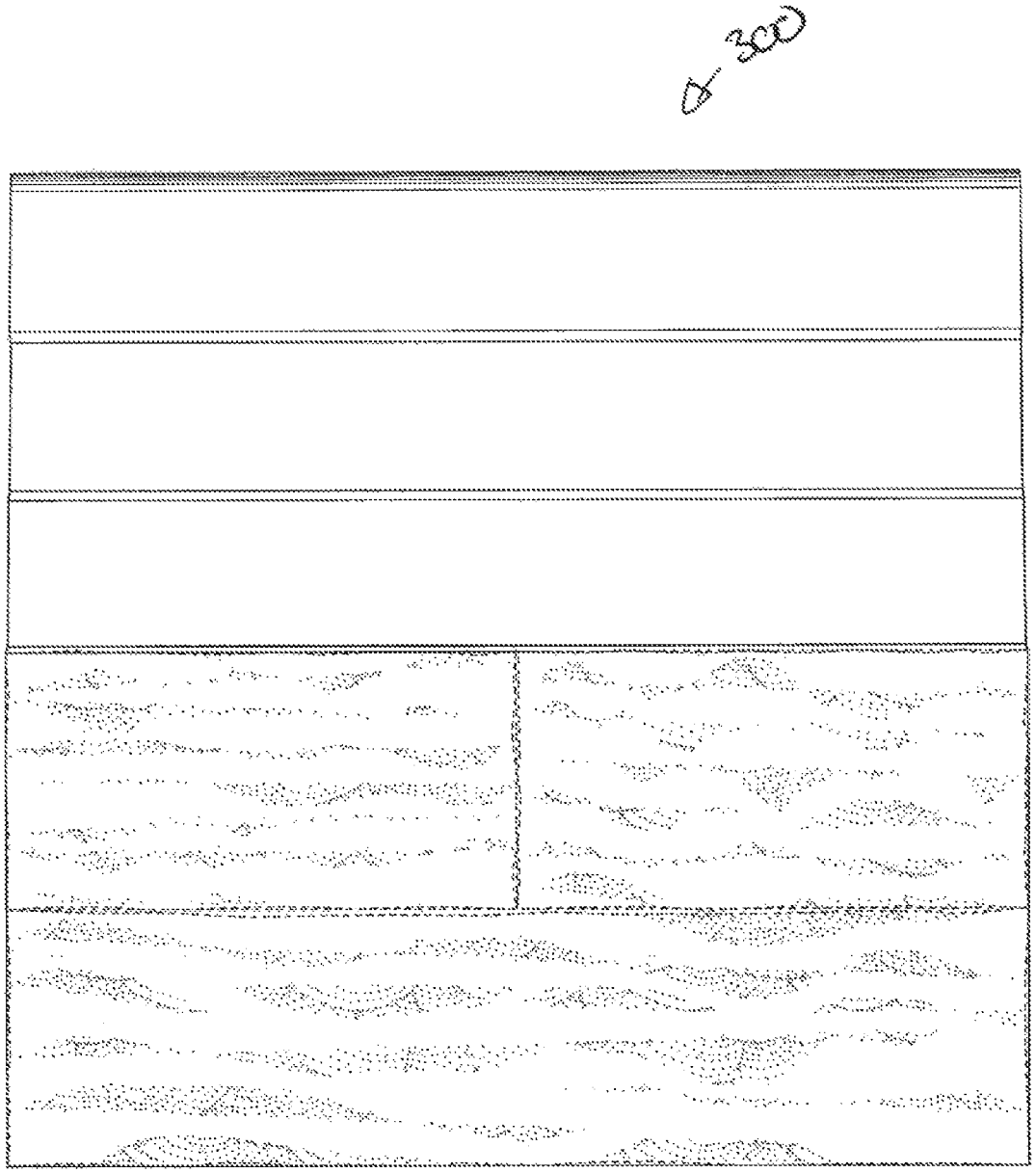
Figure 34:
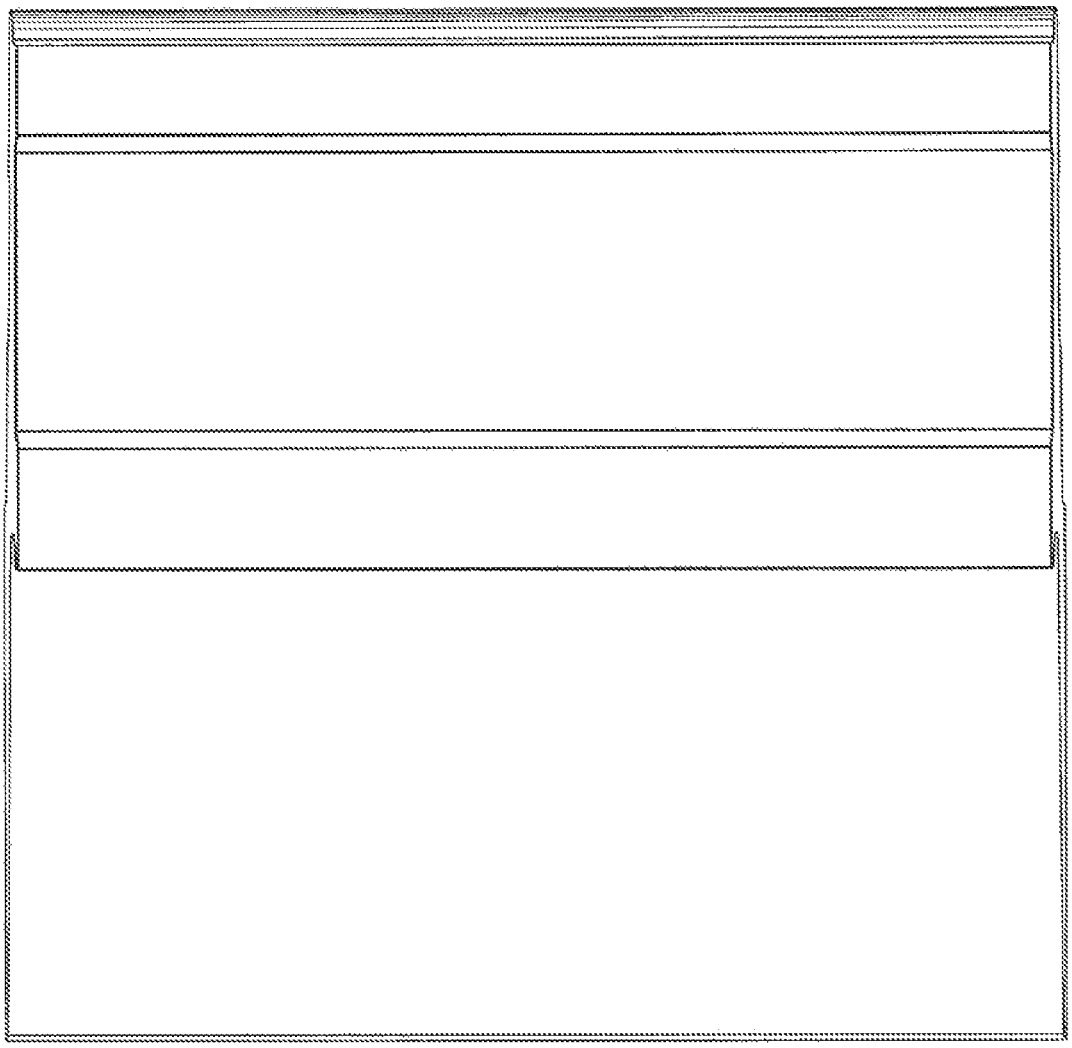
Figure 35:
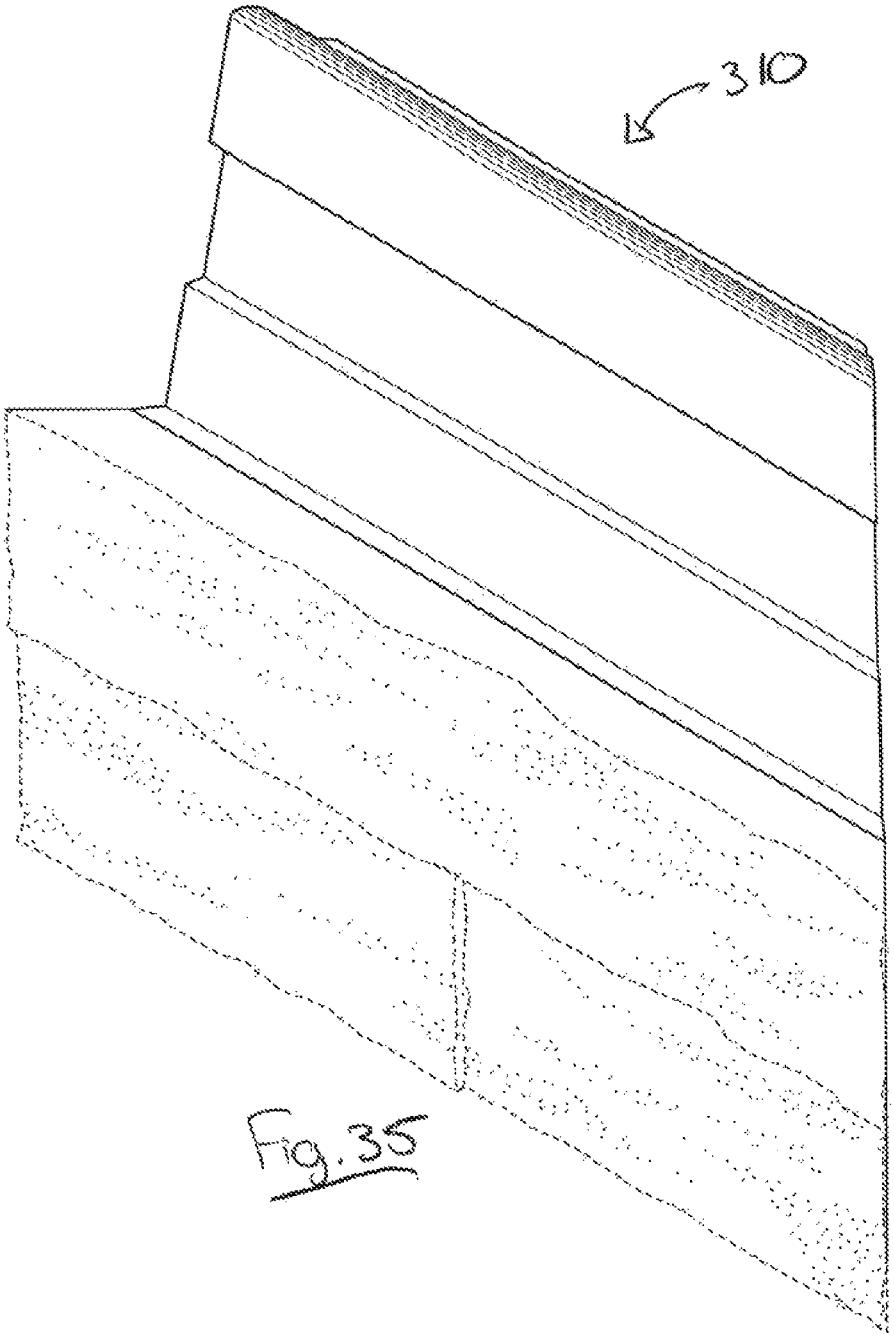
FIGS. 35-41 are perspective, left, right, top, bottom, front and rear views of a second brick element molded using a molding equipment of the present invention.
Figure 36:
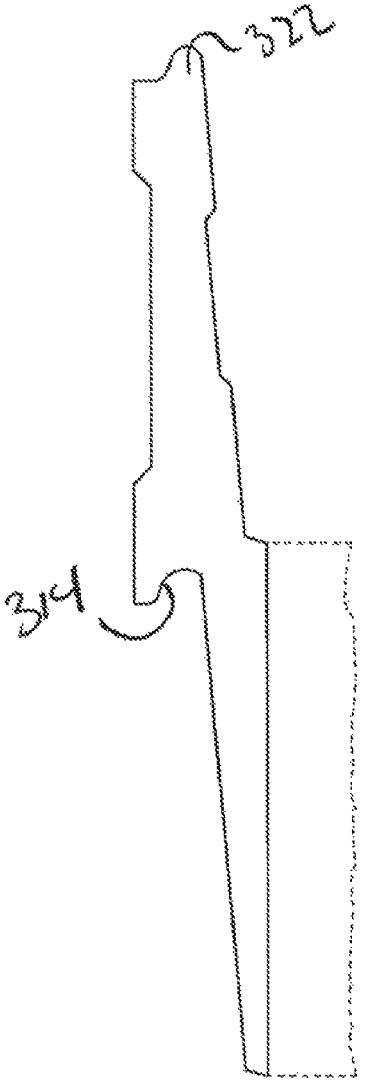
Figure 37:
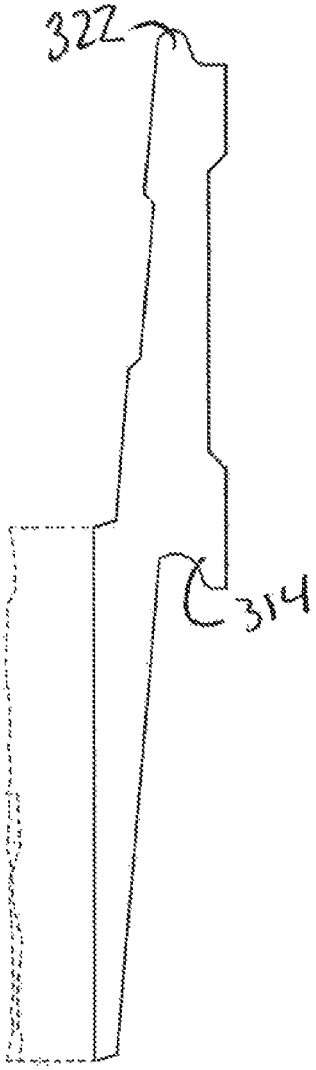
Figure 38:
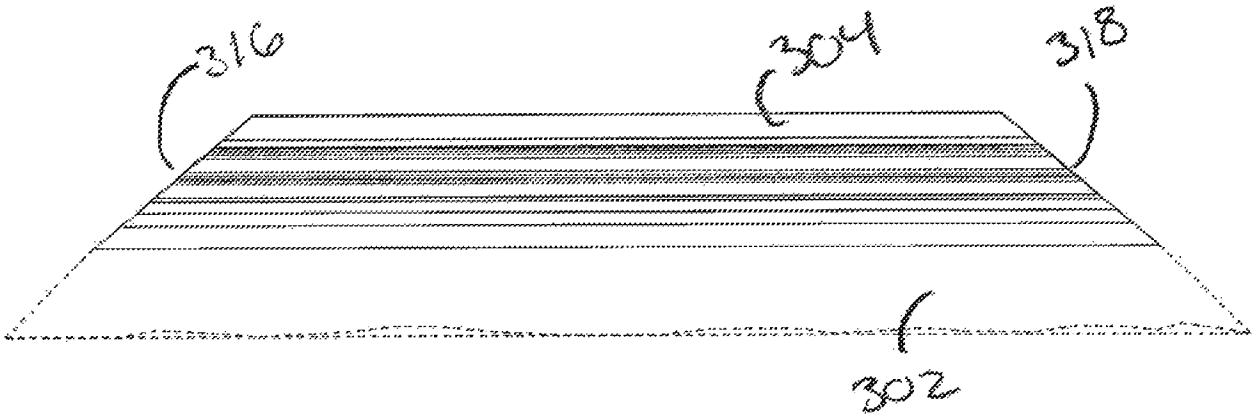
Figure 39:
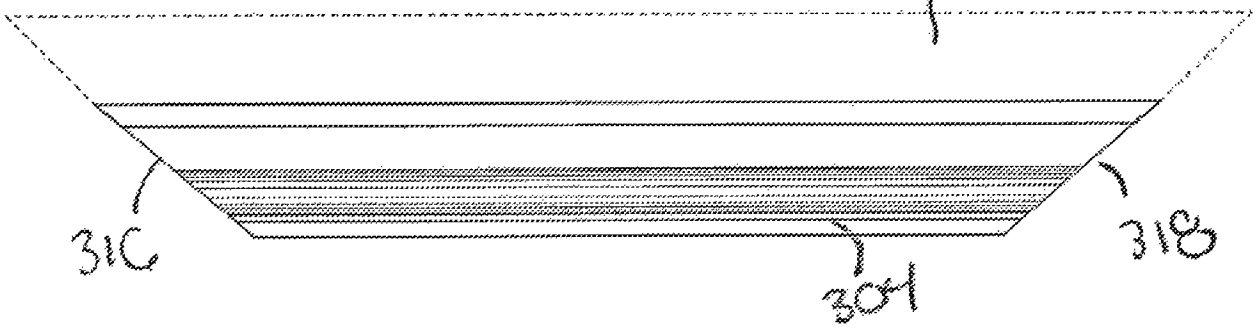
Figure 40:
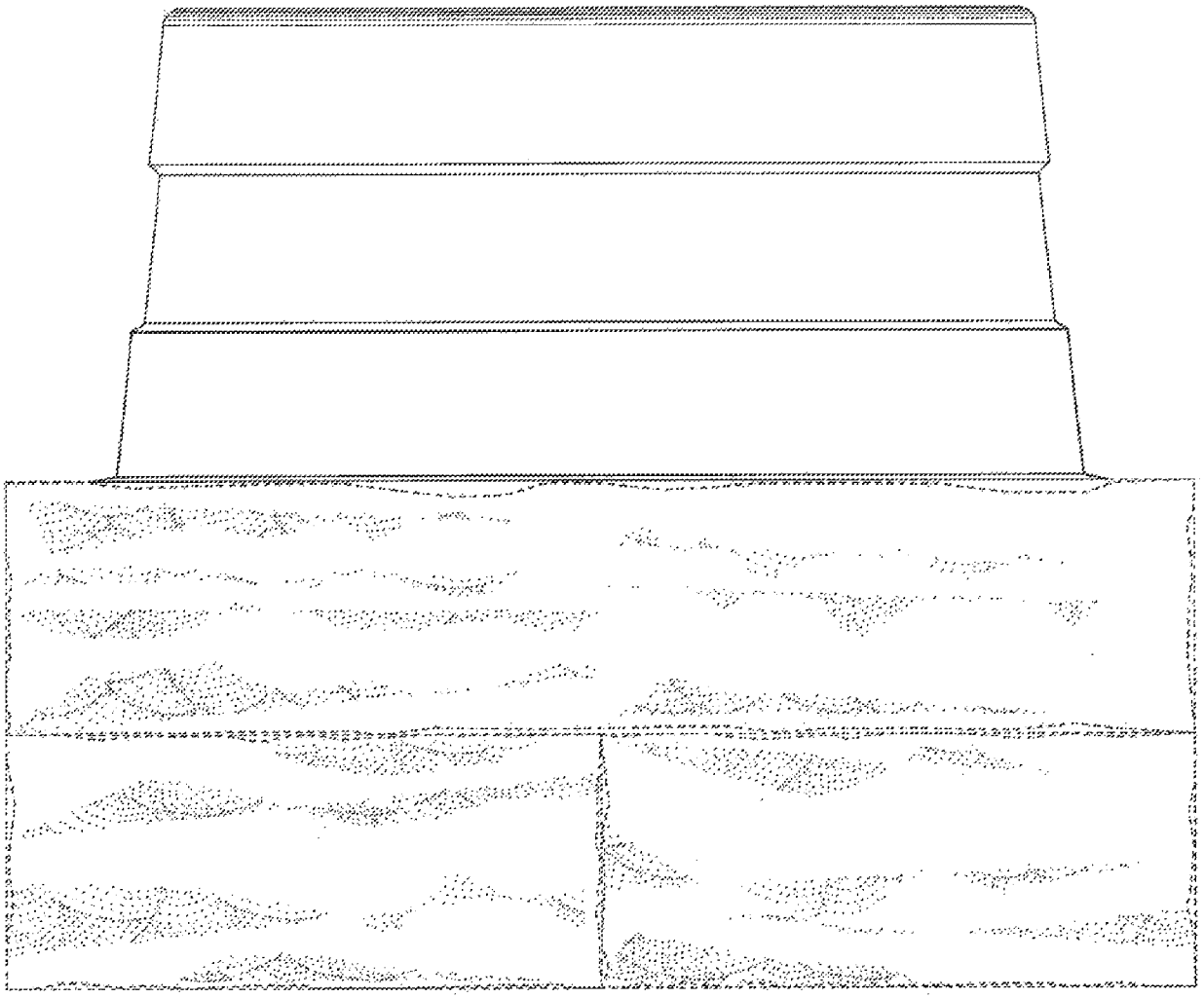
Figure 41:
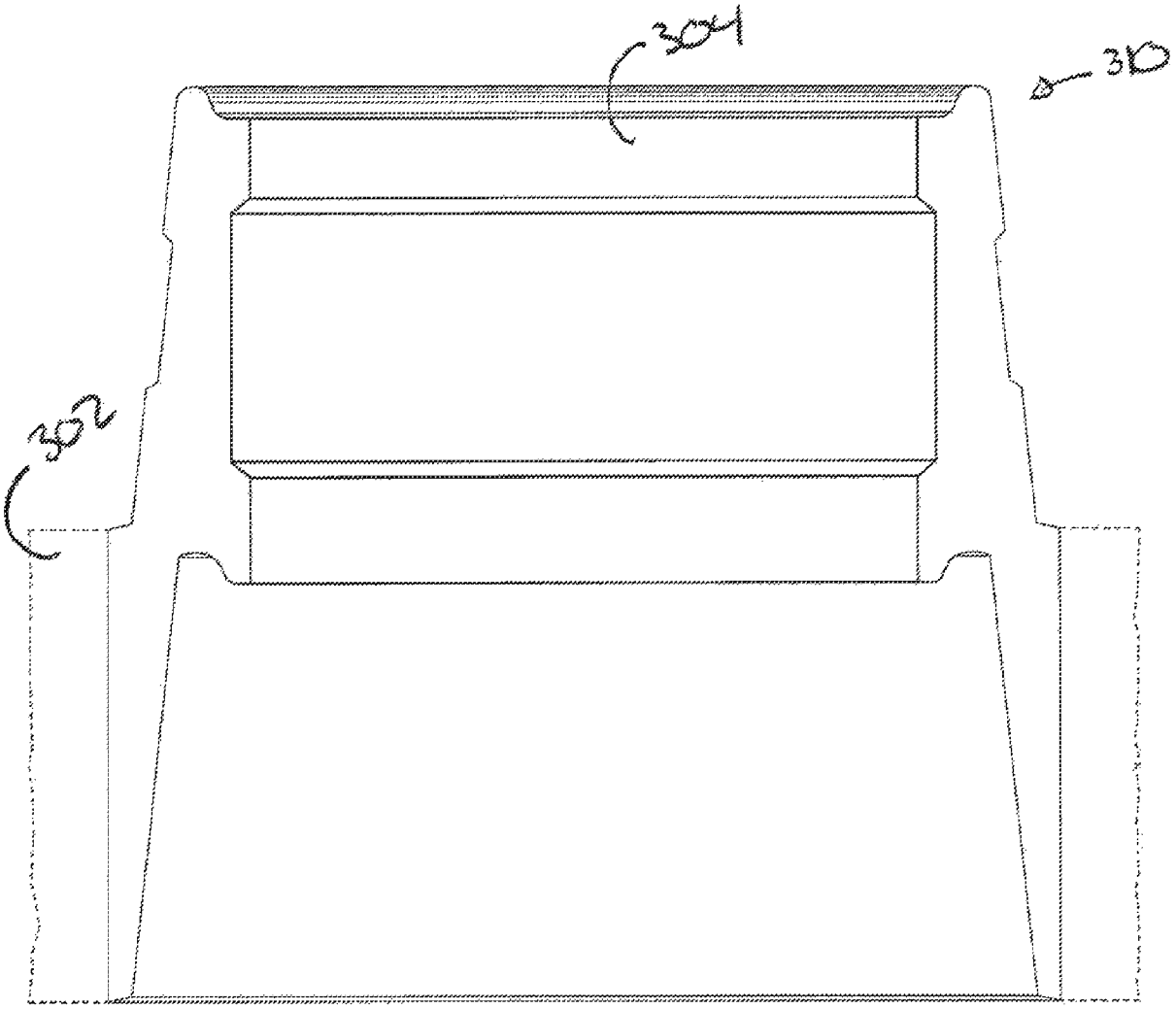
Figure 42:
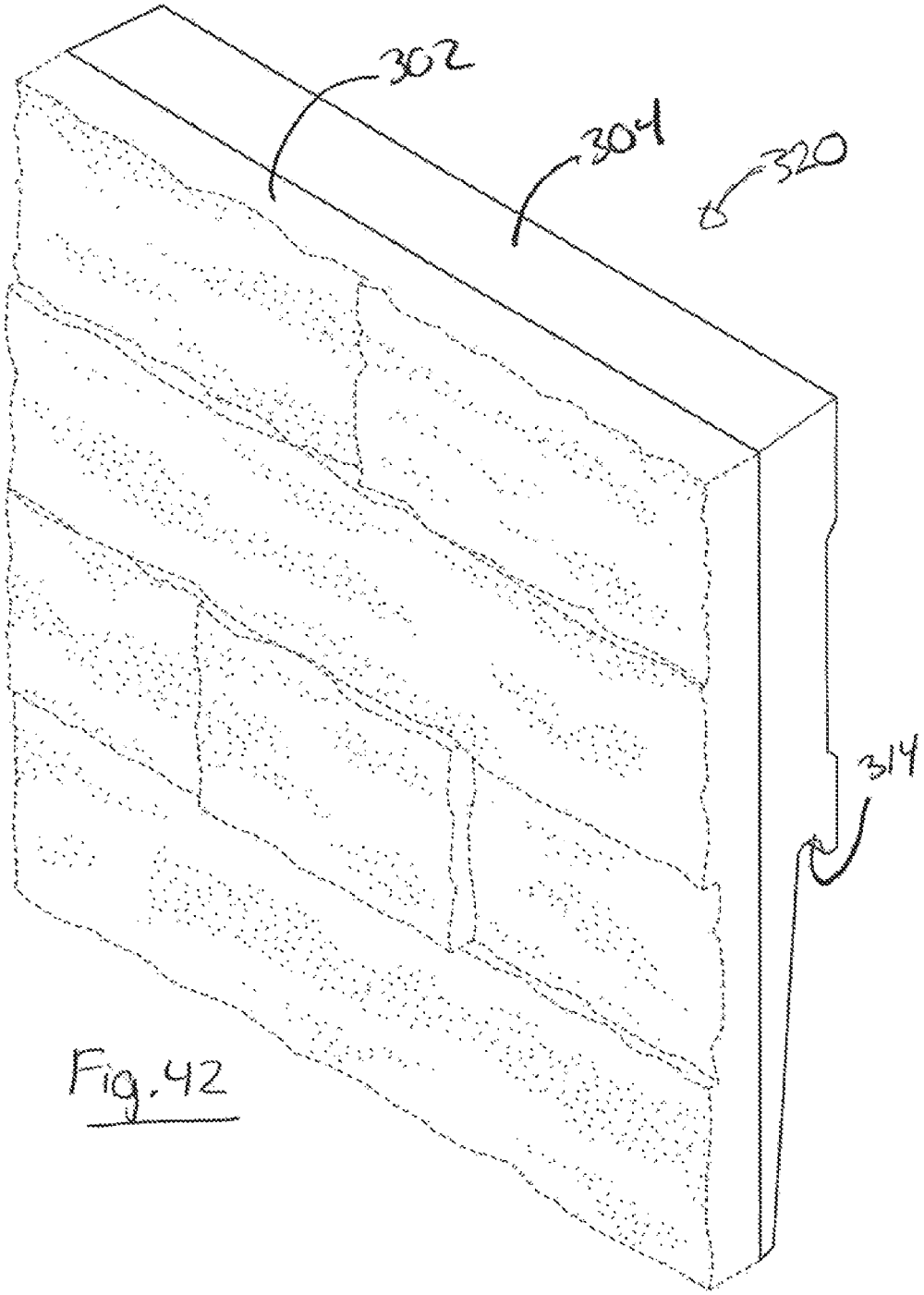
FIGS. 42-48 are perspective, left, right, top, bottom, front and rear views of a third brick element molded using a molding equipment of the present invention.
Figure 43:
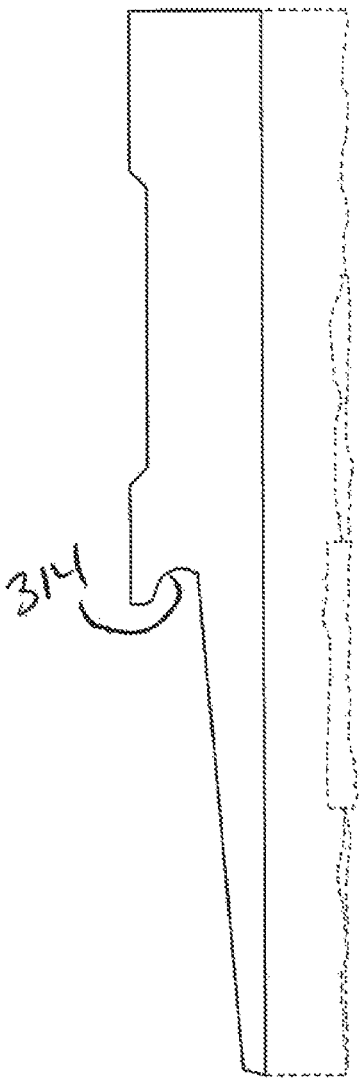
Figure 44:
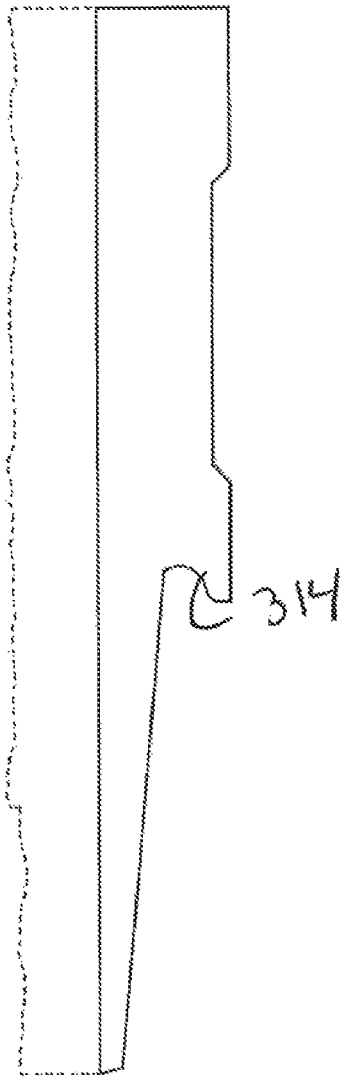
Figure 45:
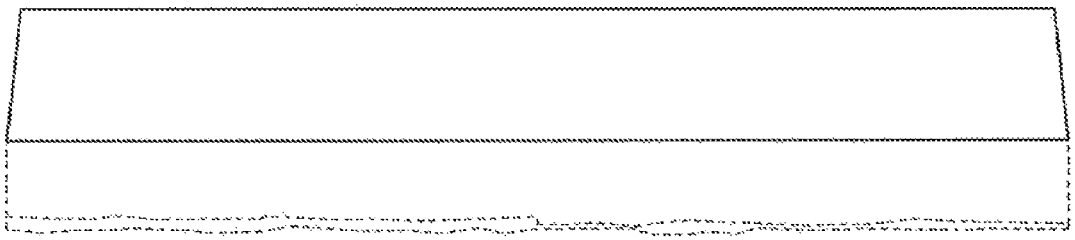
Figure 46:
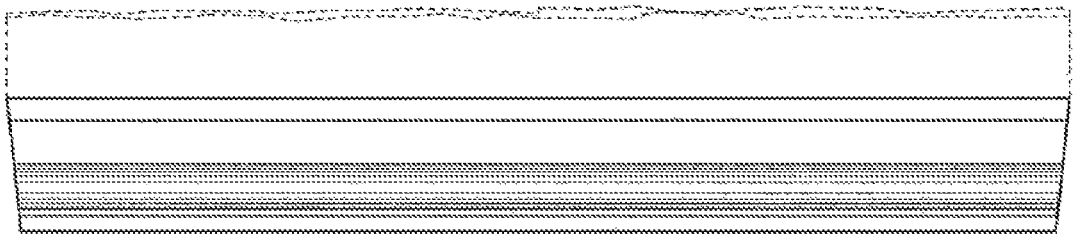
Figure 47:
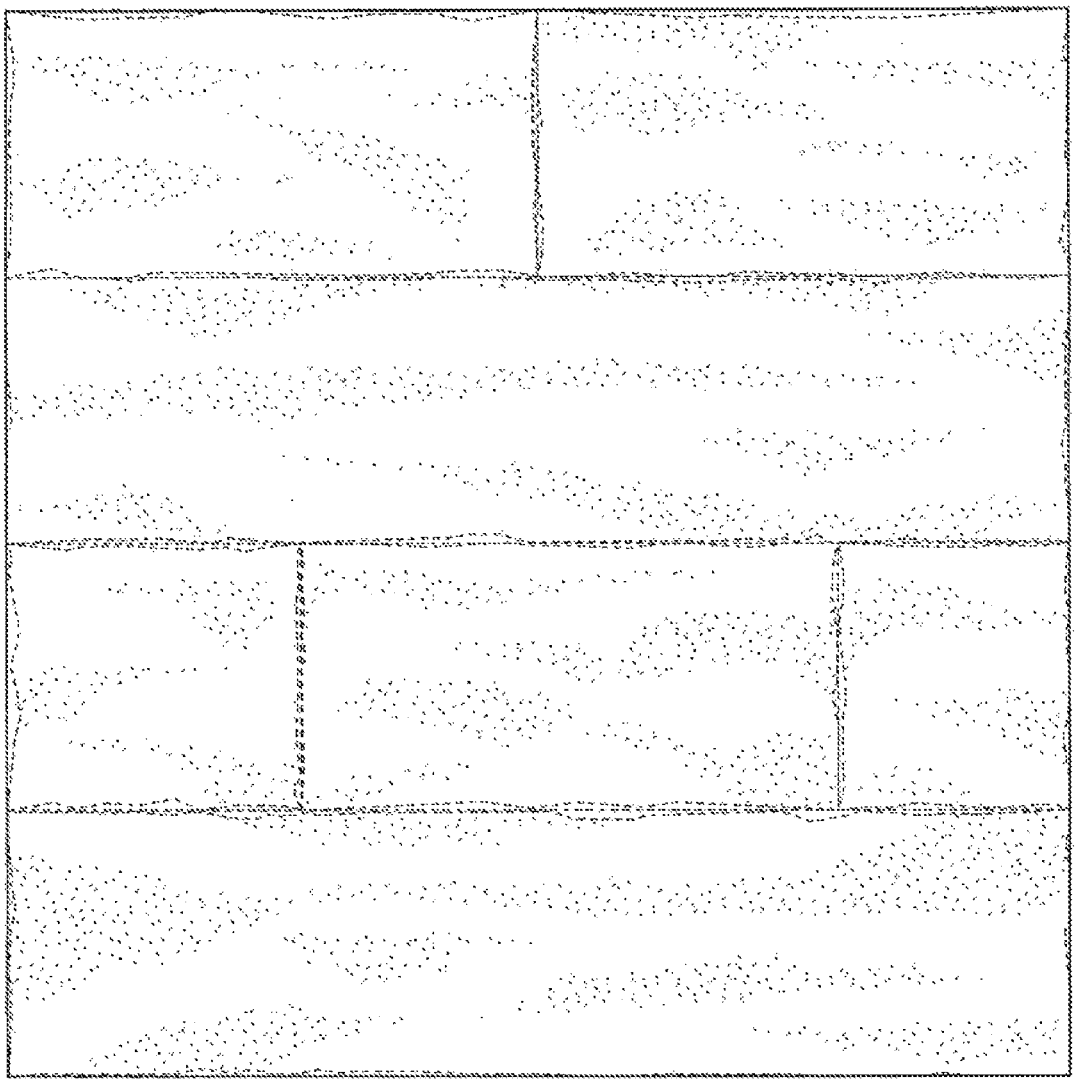
Figure 48:
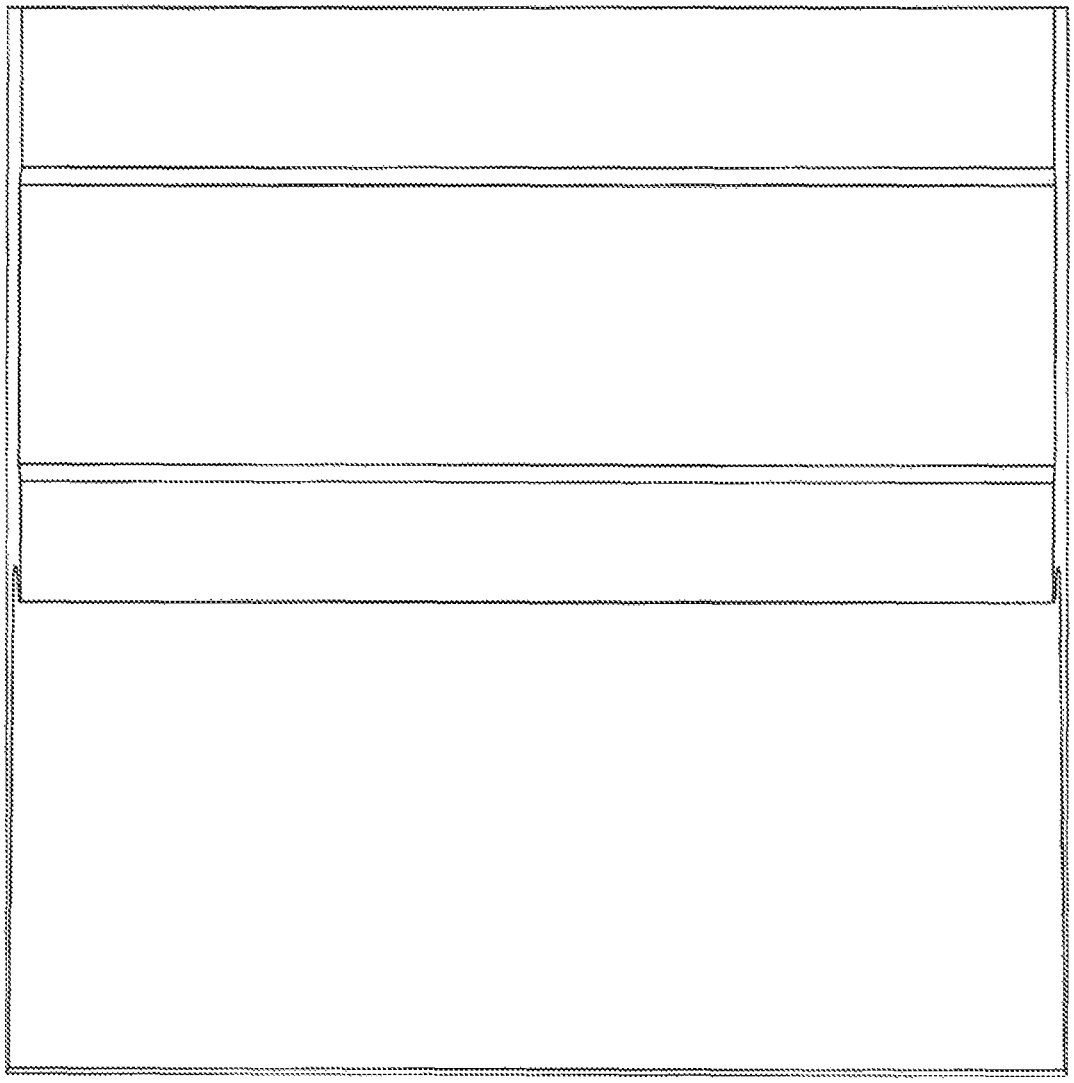
Figure 49:
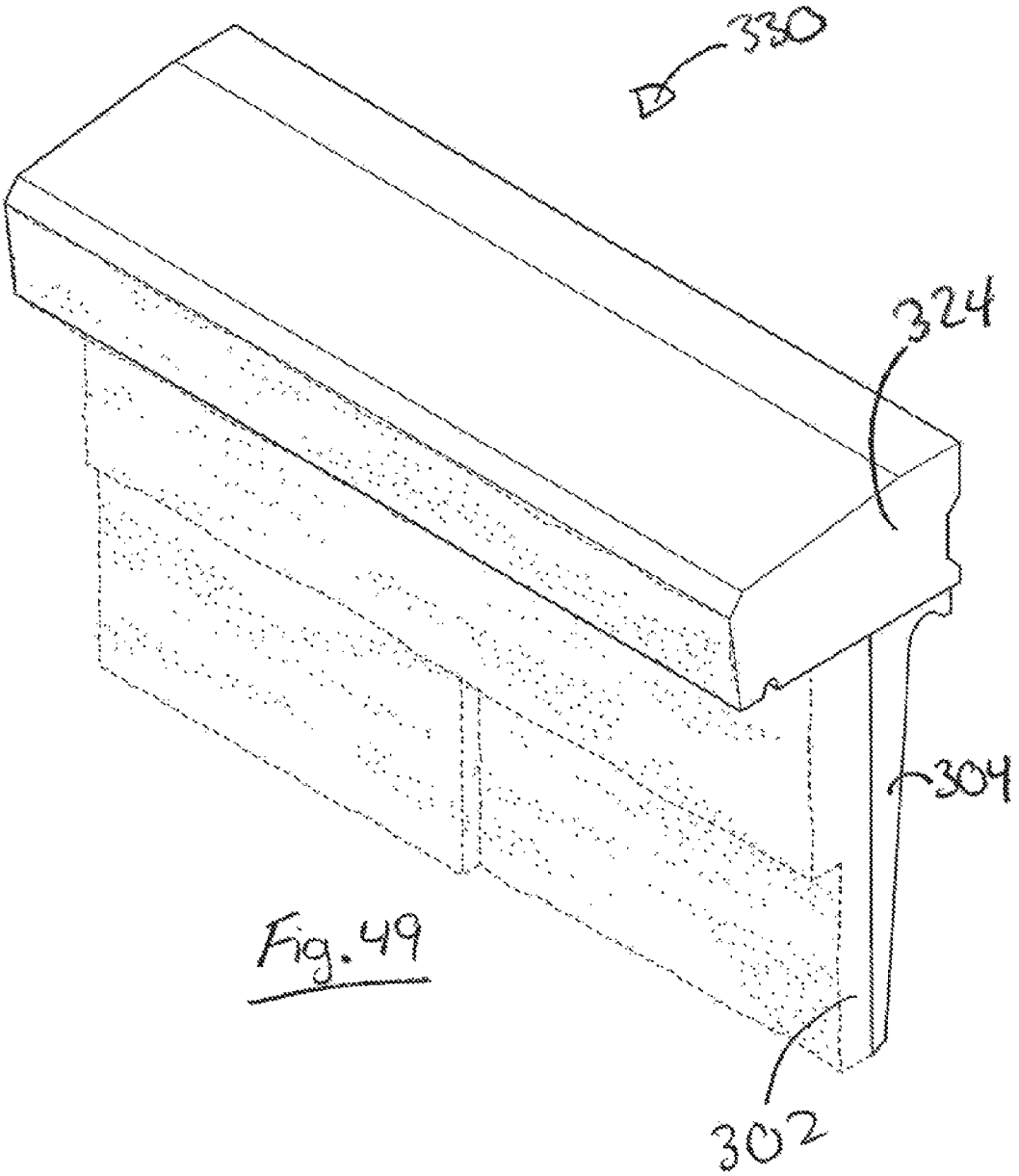
FIGS. 49-55 are perspective, left, right, top, bottom, front and rear views of a fourth brick element molded using a molding equipment of the present invention.
Figure 50:
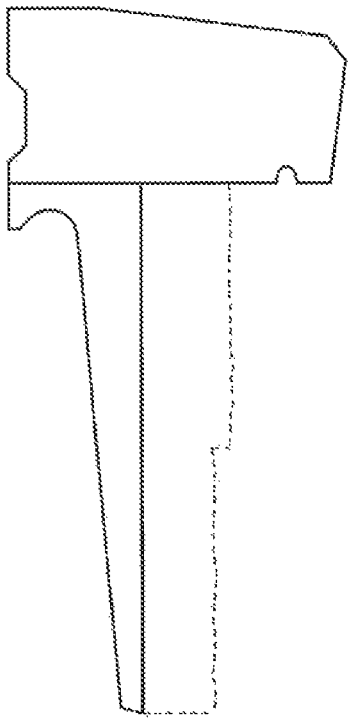
Figure 51:
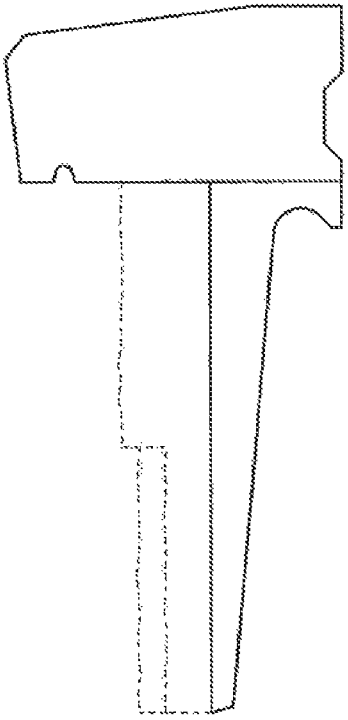
Figure 52:
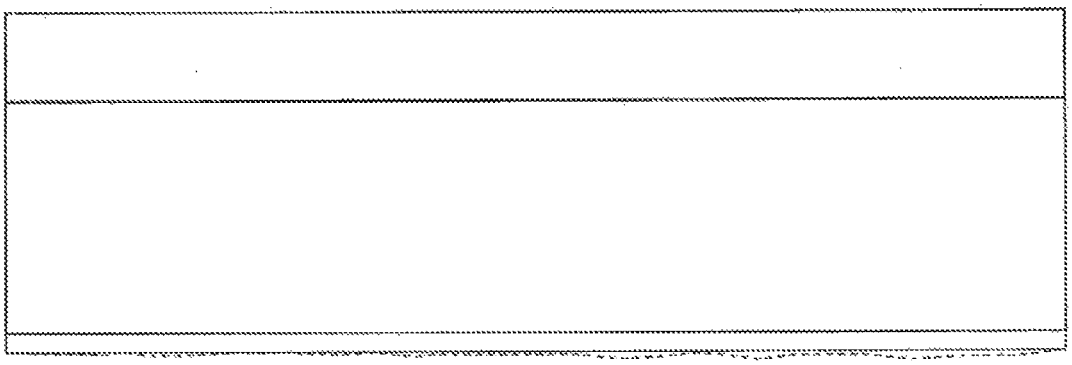
Figure 53:
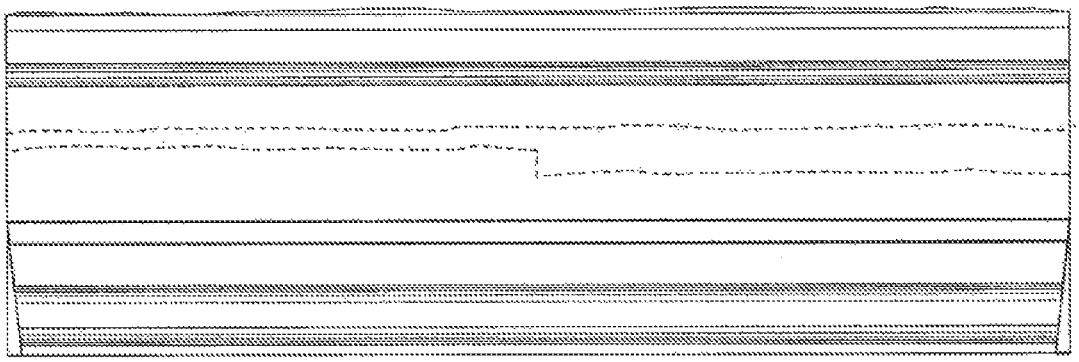
Figure 54:
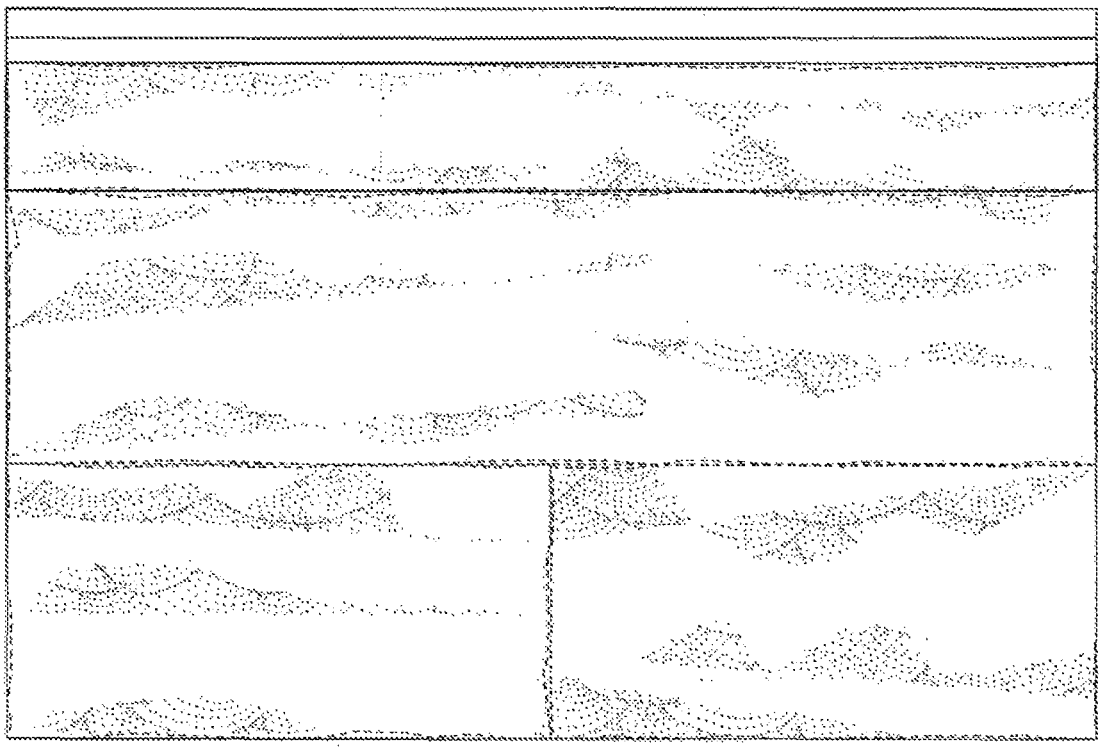
Figure 55:
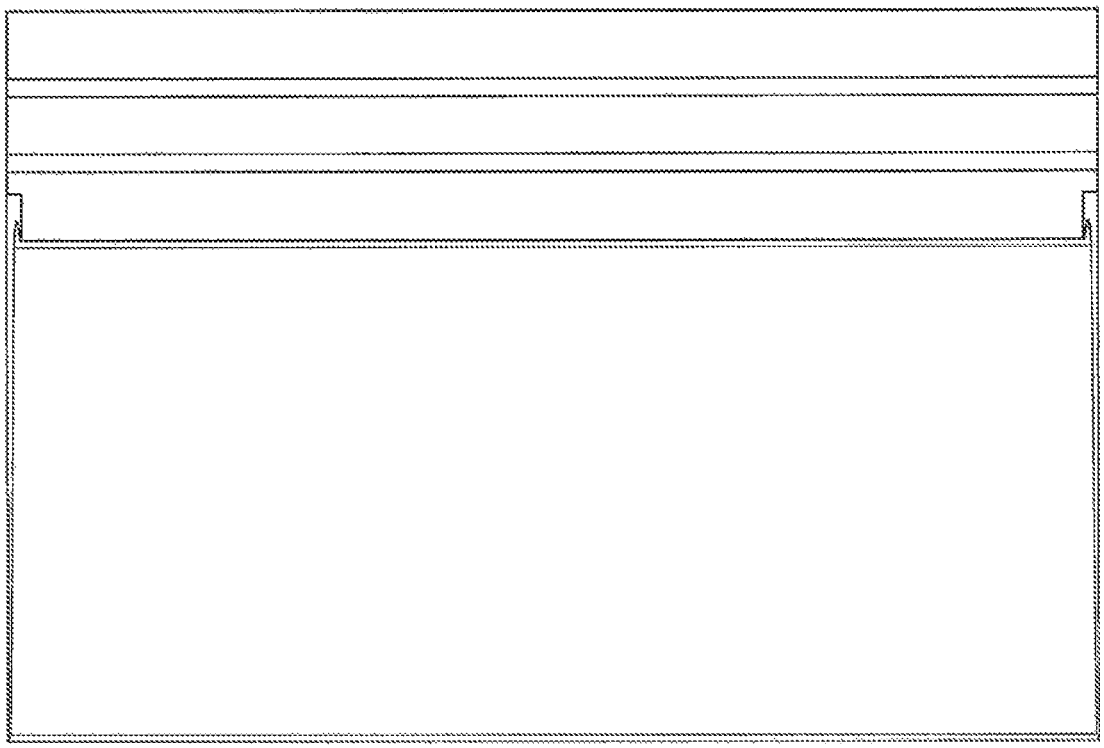
Figure 56:
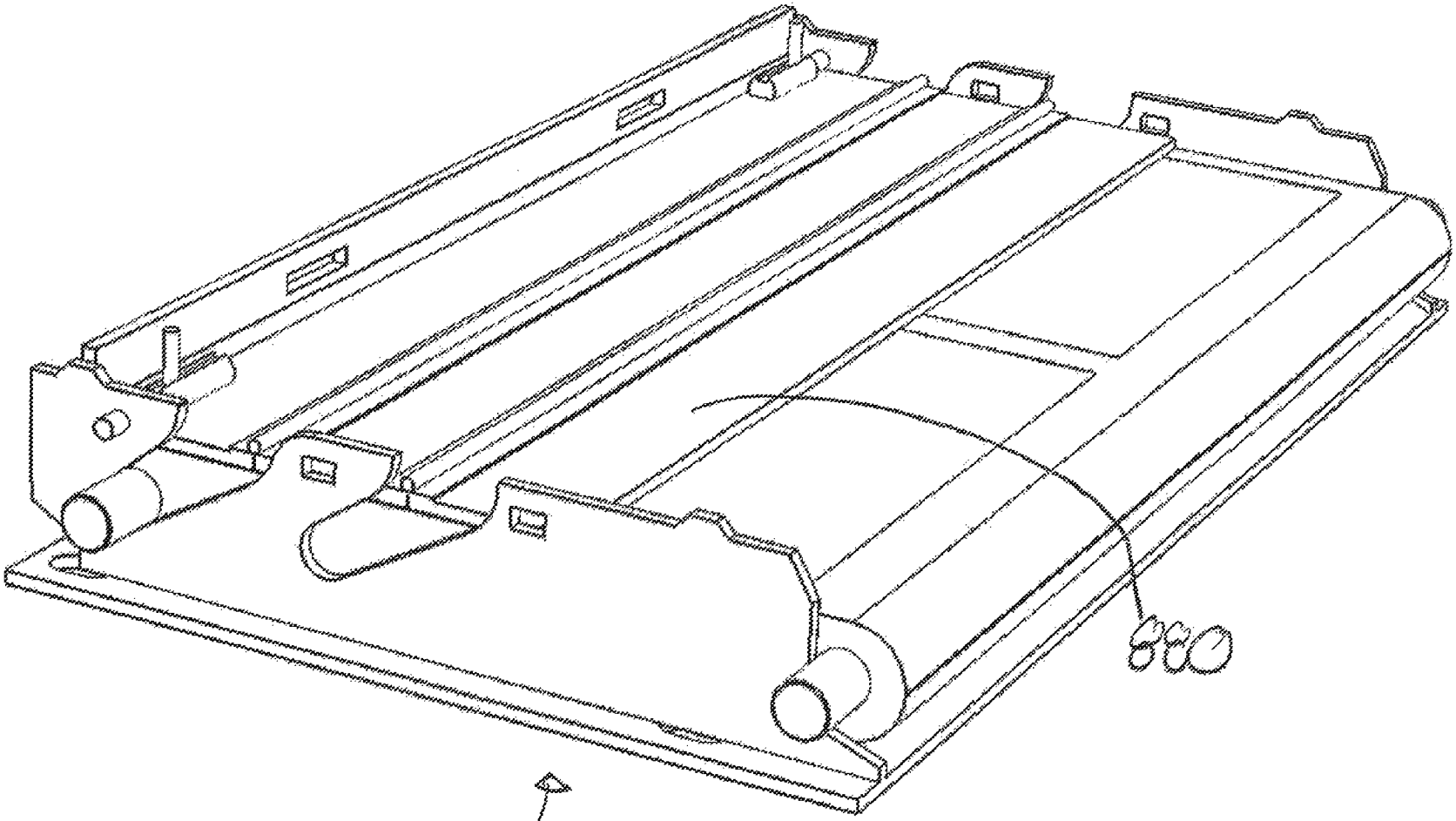
FIG. 56 is a perspective view of a second embodiment of a wet cast brick molding equipment.
Figure 54:
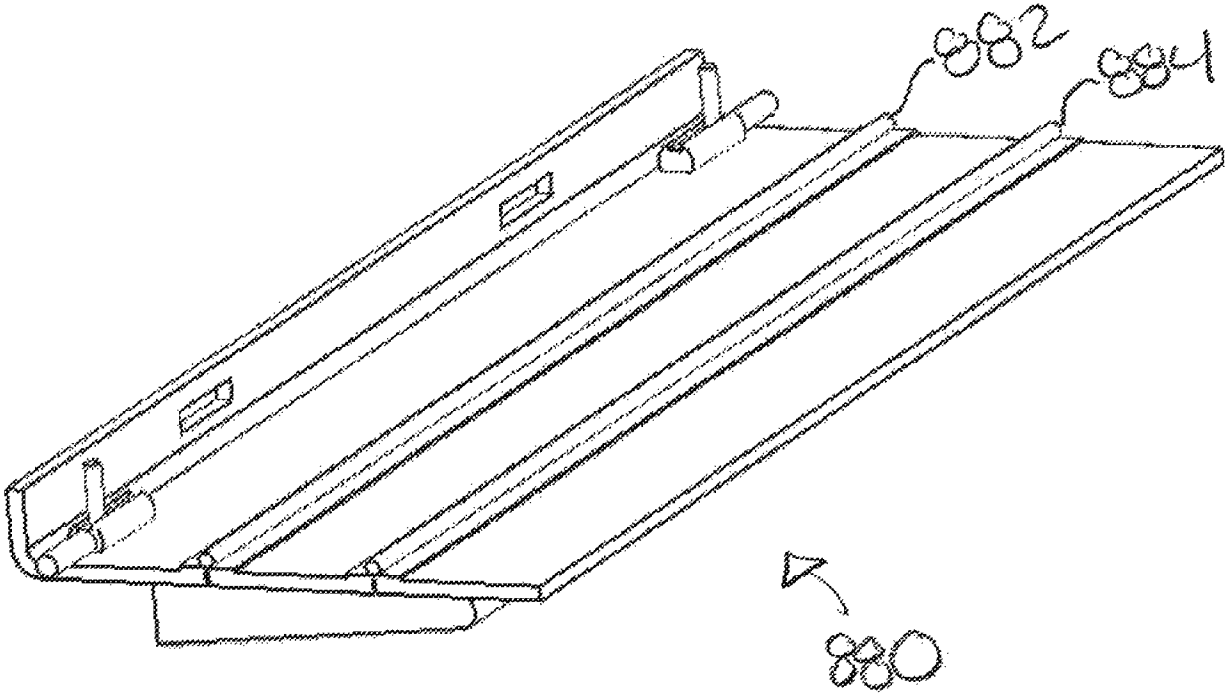
Figure 58:
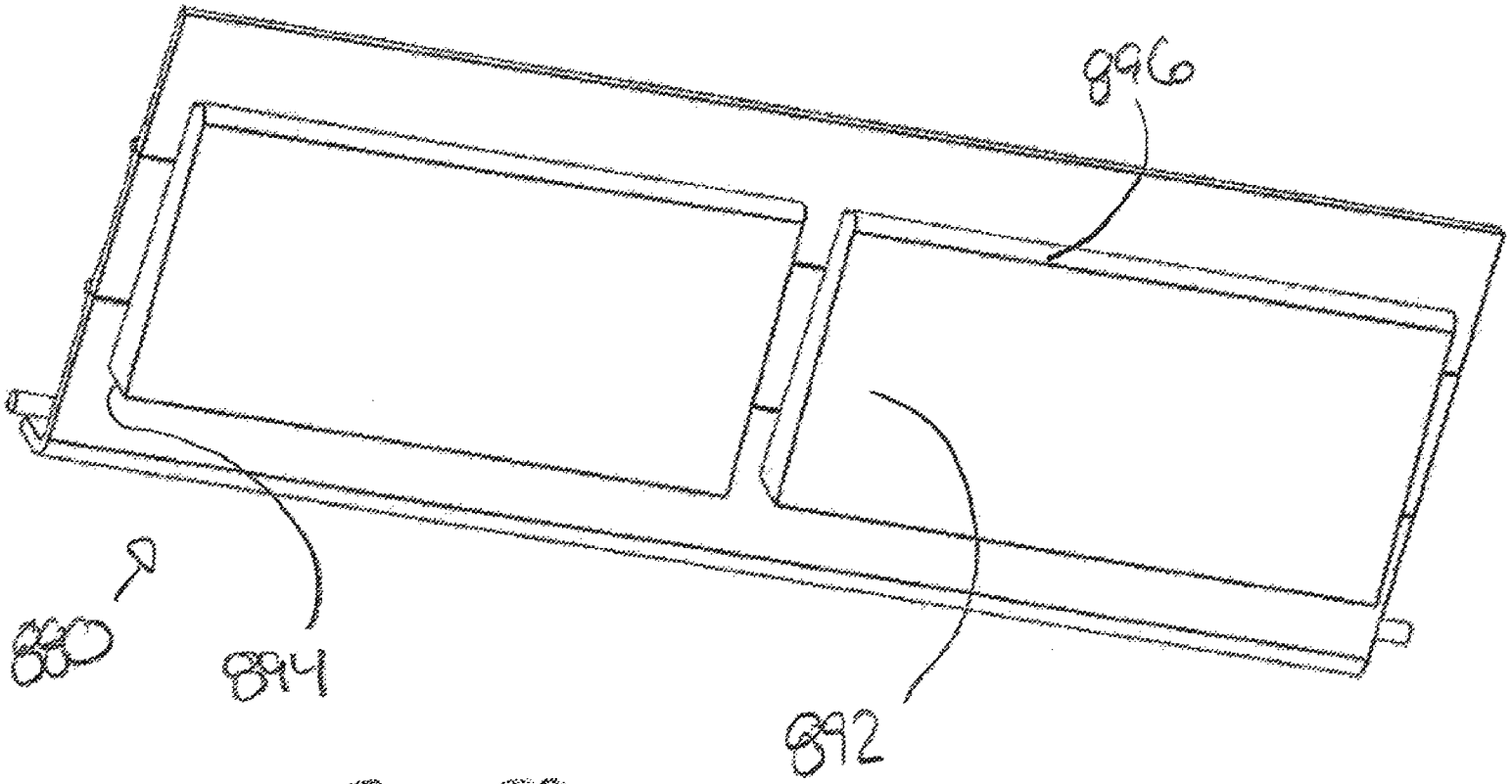
FIG. 58 is a perspective view the cover insert of the wet cast brick molding equipment of FIG. 56.
Figure 59:
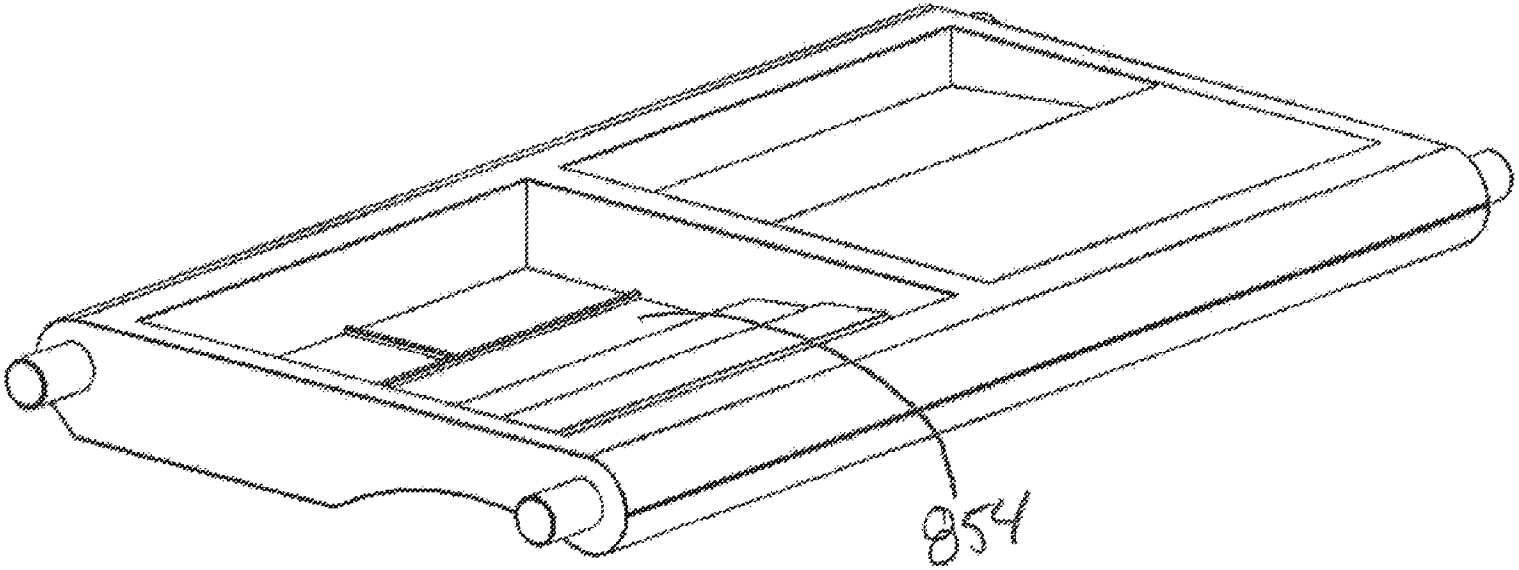
FIG. 59 is a perspective view the molding element of the wet cast brick molding equipment of FIG. 56.
Figure 60:
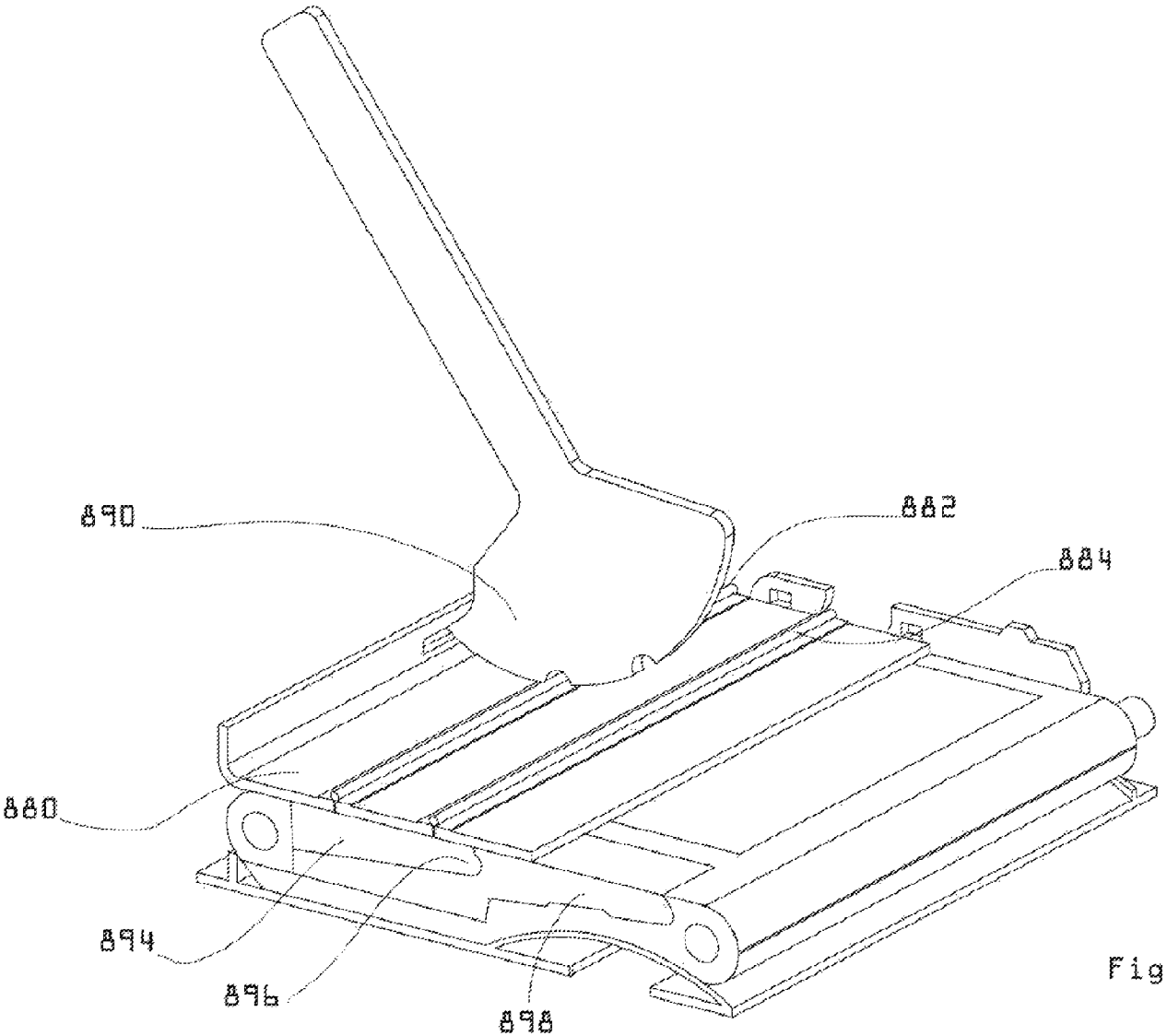
FIG. 60 is a perspective view the wet cast brick molding equipment of FIG. 56.

According to one embodiment of the present invention, now referring to FIG. 27, the cover insert 184 side 190 opposite to the lip forming side 188 is preferably at an angle with regards to a vertical axis formed by the lower face 192 of the brick element 300 to promote easy removal of the cover insert 184 and molded brick element 300 upon completion of the molding process.

Now referring to FIGS. 24-27, the wet cast molding equipment 100 according to one embodiment preferably has an unmolding aid feature formed from the arc plate 128 of the structural base portion 110 for easy removal of the cured or partly cured brick elements 300, from the molding cavities 152. The unmolding aid is an arced portion 128 in the structural base portion 110 typically hidden during molding operation by the complementary void 162 of the molding element 154. Upon unmolding, once the brick element 300 is substantially hardened to withstand the unmolding procedure, the molding portion is removed from the molding position, that is from the insertion of the first elongated member 170 in the molding opening 130 of both elevated side members 122, and further placed in the aiding unmolded position. The aided unmolded position typically required insertion of the first elongated member 170 in the unmolding opening 132 of both elevated side members 122. Upon insertion of the first elongated member 170 in the corresponding unmolding opening 132 of both elevated side members 122, a downward gradual pressure is generally applied to the second elongated member 160 located on opposite side of the molding element 154 than the first elongated member 170 to force the extraction of the brick element 300 and cover insert 184 from the molding cavities 154, thus completing the removal of the brick element 300 from the molding equipment 100.

The method for molding a brick element 300 using the molding equipment 100 of the present embodiment comprises:

- placing the molding portion 150 in the structural base portion 110;
- adding some amount of wet cast concrete in the molded cavities 154;
- placing the cover portion 180 on top of the molding portion 150 by carefully inserting the cover insert 184 in their respective position in the complementary portion of the molding cavities 154;
- locking the securing mechanism 186 of the cover portion 180 to respectively secure the cover portion 180 on the molding portion 150;
- adding wet cast concrete to fill the molding cavities 154 until enough concrete has been added;
- if required, removing any excess concrete placed in the cavities and producing a plane surface;
- storing the molding equipment away for drying and/or curing;
- preferably stacking the molding equipment 100 one on top of the other.

Notably, depending on the precise shape and configuration of the molding cavities 154, the method for molding a brick element 300 may require the molding steps be completed using a vibrating table, conveyor or other device.

After the required drying and/or curing time has lapsed, the brick elements 300 are unmolded. The unmolding may be achieved by manually deforming the preferably malleable molding element 154 and removing the cover portion 180 and brick element 300 from the molding cavity.

Alternatively while using an embodiment having an unmolding aid, the unmolding may be achieved by moving the molding portion from a first position wherein the first elongated member 170 is inserted in the molding openings 130*a*, 130*b* to a second position to a second position wherein the first elongated member 170 is inserted in the unmolding openings 132*a*, 132*b* and applying downward pressure on the second elongated member 160 as to press the underside of the molding element 154 against the unmolding aid, the arced plate 128 until sufficient deformation of the molding element 154 allows easy removal of the cover insert 184 and cover portion 180 entirely. After removal of the cover portion 180, further downward pressure is applied to the second elongated member 160 until easy removal of the brick element.

Now referring to FIGS. 28-34, according to one embodiment of the present invention, the molding equipment may be used to mold brick element 300 having a brick face portion 302 and a support section 304 typically used for securing the brick element 300 on the wall to be covered with the brick elements 300. The support sections 304 generally have an inter-engaging stacking configuration. The support section typically has a bevelled lower portion 306 connected or integrated to the brick face portion 302. The support section 304 of the brick element also preferably has left 308 and right 312 sides at a slight angle whereas the brick face portion 302 has sides a substantially right angle. During installation, one generally begin by installing any suitable starter element wherein the lip brick element 314 typically sits on. The support section 304 is generally further secured to the wall to be covered with the brick element 300.

Now referring to FIGS. 35-41, according to one embodiment of the present invention, the molding equipment may be used to mold brick element 310 having one or both sides 316, 318 at an angle. This brick element 310 is generally used to cover corners of building walls. Understandably, the angle could vary according to the configuration of the wall to be covered. According to this configuration, both the support section 304 and the brick face portion 302 are at substantially the same angle.

Now referring to FIGS. 42-48, according to one embodiment of the present invention, the molding equipment 100 may be used to mold brick element 320 having a brick face portion 302 and support section 304. The support section 304, according to this embodiment, only has a lip element 314 for stacking on top of a previous brick layer. Accordingly, this plate brick element 320 does not have superior lip engaging feature 322 thus preventing further stacking of additional brick element on top thereof. As such, the present brick element 320 is generally used for the upper most layer of brick elements 320. Furthermore, the brick face portion 302 of the present brick element 320 substantially overlaps the support section 304 connected or integrated therewith.

Now referring to FIGS. 49-55, according to one embodiment of the present invention, the molding equipment may be used to mold brick element 330 also having a brick face portion 302, a support section 304 and a cover element 324. Understandably, the cover element 324 could vary from one embodiment to the other. In this embodiment, the brick element 330 does not have superior lip engaging feature 322 thus preventing further stacking of additional brick element 300, 310, 320, 330 on top thereof. As such, the present brick element 330 is generally used for the upper most layer of brick elements 330. It could however, also be user under wall openings, such as windows or doors. Furthermore, the brick face portion 302 of the present brick element 330 substantially overlaps the support section 304 connected to or integrated therewith.

Now referring to FIGS. 56-60, according to one embodiment, the brick molding equipment 800 could have two molding cavities 854. According to this embodiment, the brick molding equipment 800 comprise a cover portion 880 having hinges 882, 884 to promote cover portion 880 removal during unmolding. As such, following the drying and/or curing period, the cover portion 880 is preferably sequentially pulled using a specifically designed tool 890 allowing removal of the cover insert 892 from the side 894 opposite the lip forming element 896 to the lip forming side 896 thus minimising the strain applied to the lip element 898.

While illustrative and presently preferred embodiments of the invention have been described in detail hereinabove, it is to be understood that the inventive concepts may be otherwise variously embodied and employed and that the appended claims are intended to be construed to include such variations except insofar as limited by the prior art.

The invention claimed is:

1. A wet cast molding equipment for molding individual stackable inter-engaging bricks, the molding equipment comprising:

a structural base portion comprising a base plate, right and left side elevation members extending vertically from the base plate, and a stopper plate extending vertically from the base plate between right and left side elevation members;

a molding module adapted to be received into the structural base portion and having at least one molding cavity adapted to cast a material adapted to be cast to produce a brick, the molding module defining a first brick longitudinal side and a second brick longitudinal side; and a cover releasably secured to the structural base, the cover comprising a cover insert having a lip forming element for creating an inter-engaging lip portion on the brick, the cover at least partially covering the at least one molding cavity;

wherein each of the right and left side elevation members comprises a molding opening forming a notch adjacent to the stopper plate, the modling openings being adapted for receiving and supporting a first elongated member extending from the molding module, maintaining as such the molding module in place in the structural base during molding wherein each of the first and second elevation elements comprises a releasing opening forming a notch adjacent to the molding opening to receive and support the first elongated member of the molding module during the unmolding of the brick.

2. The molding equipment of claim 1, wherein the side elevation members comprise securing mechanisms for retaining the cover on top of the molding cavity during molding, said securing mechanisms comprising securing openings through the side elevation members configured for receiving a bar memeber extending horizontally from the cover.

3. The molding equipment of claim 1, wherein the structural base portion has a second elongated member longitudinally inserted thereto.

4. The molding equipment of claim 1, further comprising a cover plate comprising longitudinally elevated sides for increasing the cover longitudinal and torsional strength.

5. The molding equipment of claim 4, wherein the cover plate is secured to the cover insert using glue.

6. The molding equipment of claim 1, the cover insert is made from a flexible material.

7. The molding equipment of claim 1, wherein the molding module comprises three distinct molding cavities and three corresponding cover inserts.

8. The molding equipment of claim 1, wherein a side of the cover insert opposite to a side forming the lip forming element is at an angle with a vertical plane formed by a lower face of the brick.

9. The molding equipment of claim 1, further having an unmolding aid formed from an arc plate integrated to the structural base portion.

10. The molding equipment of claim 1, wherein the molding equipment comprises an arc plate member mounted on the structural base portion and engaging with both side elevation members through apertures located thereto.

11. The molding equipment of claim 10, wherein the structural base portion has weight reducing openings located under the arc plate.

12. A method of making wetcast brick using the wet cast molding equipment of claim 1, the method comprises the steps of:

a) placing the molding module in the structural base portion by inserting the first elongated member in the molding openings each forming a notch adjacent to the stopper plate;

b) adding some amount of the material adapted to be cast to produce the brick in the molding cavity of the molding module, c) placing the cover on top of the molding cavity by inserting the cover insert in its respective position in a complementary portion of the molding cavity, and d) releasably securing the cover on the molding module to at least partially cover the molding cavity.

13. A method of making wetcast brick as claimed in claim 12, the method further comprising the steps of:

e) removing any excess concrete placed in the cavities for producing a plane surface; and f) storing the molding equipment away for drying and/or curing.

14. A method of making wetcast brick as claimed in claim 13, the method further comprising the steps of:

g) removing the first elongated member from the molding openings and removing the molding portion from the structural base portion;

h) inserting the first elongated member in releasing openings forming a notch on both side elevation members adjacent to the molding openings;

i) applying a downward pressure to a second elongated member located on the opposite side of the molding module in relation to the first elongated member to force the extraction of the brick and cover insert from the molding cavities, and remove the brick from the molding module.

15. The molding equipment of claim 1, wherein the material adapted to cast and produce the brick is wet cast concrete.

16. The method of claim 12, wherein the material adapted to cast and produce the brick is wet cast concrete.

* * * * *